US011337524B2

(12) United States Patent
Weidhas

(10) Patent No.: US 11,337,524 B2
(45) Date of Patent: May 24, 2022

(54) ERGONOMICALLY ADJUSTABLE RECLINER

(71) Applicant: Gerhard Weidhas, Kulmbach / Forstlahm (DE)

(72) Inventor: Gerhard Weidhas, Kulmbach / Forstlahm (DE)

( * ) Notice: Subject to any disclaimer, the term of this patent is extended or adjusted under 35 U.S.C. 154(b) by 0 days.

(21) Appl. No.: 17/050,920

(22) PCT Filed: Jan. 10, 2019

(86) PCT No.: PCT/EP2019/050522

§ 371 (c)(1),
(2) Date: Oct. 27, 2020

(87) PCT Pub. No.: WO2019/206464

PCT Pub. Date: Oct. 31, 2019

(65) Prior Publication Data

US 2021/0227977 A1 Jul. 29, 2021

(30) Foreign Application Priority Data

Apr. 27, 2018 (DE) ..... 102018003458.6

(51) Int. Cl.
*A47C 1/14* (2006.01)
*A47C 1/032* (2006.01)

(52) U.S. Cl.
CPC ..... *A47C 1/0347* (2013.01); *A47C 1/143* (2013.01)

(58) Field of Classification Search
CPC .... A47C 1/0347; A47C 17/163; A47C 3/0257
See application file for complete search history.

(56) References Cited

U.S. PATENT DOCUMENTS 2,807,310 A * 9/1957 Sellner ..... A47C 3/0255 297/88
5,344,216 A 9/1994 Suominen
(Continued)

FOREIGN PATENT DOCUMENTS

DE 34 43 374 A1 5/1986
DE 86 26 550 U1 2/1987
DE 103 01 326 A1 7/2004

OTHER PUBLICATIONS

PCT Search Report & Written Opinion dated Feb. 21, 2019 (with English Translation), Application No. PCT/EP2019/050522, Applicant Weidhas, Gerhard, 18 Pages.

*Primary Examiner* — Sarah B McPartlin
(74) *Attorney, Agent, or Firm* — Brooks Kushman P.C.

(57) ABSTRACT

A recliner for variable adjustment between a substantially horizontal position and an ergonomic seating position includes right-hand and left-hand side parts, which are each made up of an outer side part and an inner side part. The recliner also comprises a backrest element and a seat-surface element, which are connected to one another for rotation via a first bearing rod, as well as a foot-part element, which is connected to the seat-surface element for rotation via a second bearing rod. The foot-part element is mounted between the right-hand and left-hand side parts via a third bearing rod. The first, second and third bearing rods are each mounted for translatory movement in a corresponding guide in the right-hand and left-hand side parts such that the backrest element, the seat-surface element and the foot-part element can be adjusted in a variable manner between a substantially horizontal position and an ergonomic seating position.

9 Claims, 27 Drawing Sheets

(56) References Cited

U.S. PATENT DOCUMENTS

| | | | | |
|---|---|---|---|---|
| 7,198,325 | B2 | 4/2007 | Dewert | |
| 10,232,744 | B2 * | 3/2019 | Meister | B60N 2/838 |
| 2004/0034934 | A1 * | 2/2004 | Weinman | A47C 20/041 5/618 |
| 2016/0214565 | A1 * | 7/2016 | Bell | B60R 22/26 |

* cited by examiner

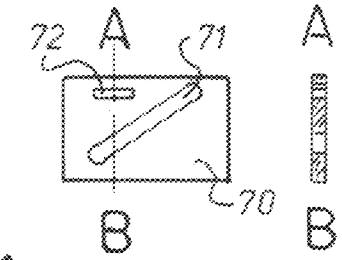
FIG.11a
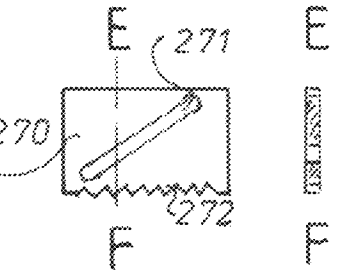
FIG.11c
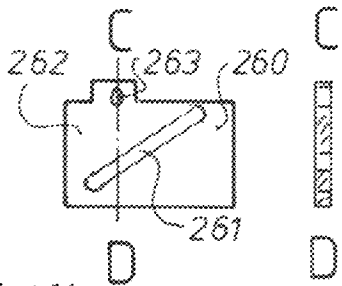
FIG.11b
FIG.11d
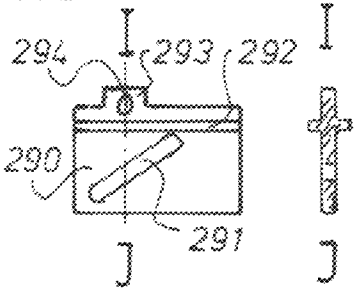
FIG.11e
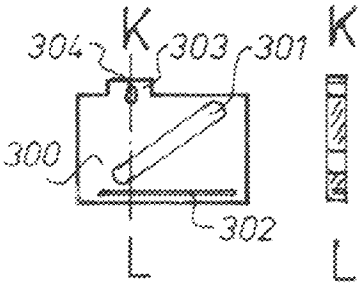
FIG.11f

ERGONOMICALLY ADJUSTABLE RECLINER

CROSS-REFERENCE TO RELATED APPLICATIONS

This application is a U.S. national phase of PCT Application No. PCT/EP2019/050522 filed on Jan. 10, 2019, which claims priority to German Patent Application No. 10 2018 003 458.6 filed on Apr. 27, 2018, the disclosures of which are incorporated in their entireties by reference herein.

TECHNICAL FIELD

The present disclosure relates to an ergonomically adjustable reclining device for one or more persons.

BACKGROUND

A conventional, non-ergonomic couch usually has only a limited range of adjustment (approx. 4 positions) between sitting and lying position or a power-intensive adjustment. Apart from the inconvenience, it is often difficult or awkward to leave the position already taken without having to get up from the couch.

With many adjustable recliners that are not ergonomically designed, the kink or axis of rotation is only in the back area and causes back tensions or pressure points when leaning against the backrest for a longer period of time, which can only be avoided by additionally supporting a cushion or padded support.

Although there are ergonomic recliners, some of them are not adjustable at all or only to a limited extent. The adjustability of these well-known couches is usually complicated and elaborate or a power connection for the motor is required. Therefore, these well-known couches are not suitable for every outdoor location (e.g., beach or terrace without electricity).

SUMMARY

It is thus the object of the present disclosure to provide a device for variable adjustment of the position between an essentially horizontal position and an ergonomically seated position, whereby the device shall be designed in such a way that it is easy and inexpensive to manufacture.

The aforementioned object is solved according to the disclosure by a device for variable adjustment of the position between an essentially horizontal position and an ergonomically seated position.

The device according to the disclosure comprises a right and a left side part, each of which is composed at least of an outer side part and an inner side part, a backrest element and a seat element, which are rotatably connected to each other via a first bearing block, and a foot element, which is rotatably connected to the seat element via a second bearing block, wherein the foot element is supported via a third bearing block between the right and left side parts, wherein the first and the second bearing block are connected to each other via a second bearing block, second and third bearing block is mounted in each case in a corresponding guide in the right and left side part in such a way that it can be moved in translation in such a way that the backrest element, the seat surface element and the footrest element can be adjusted variably between a substantially horizontal position and an ergonomic sitting position, and wherein the first bearing block is locked by self-locking via a locking slide in a locking cutout in at least one outer side part, and wherein the self-locking can be lifted by the user via a hand knob.

This solution is particularly advantageous in that, due to the interconnected elements, which can each be moved in translation in a corresponding guide in the right and left side panel, the self-locking mechanism is released when the hand knob is operated by the user and the lying device can be variably adjusted between the seated ergonomic position and the lying ergonomic position. It is particularly advantageous that, due to the self-locking feature, no user action is required to maintain the ergonomic position. In addition, it is not necessary for the user to stand up from the invented reclining device if the reclining device is to be variably adjusted between the seated ergonomic position and the reclining ergonomic position, as the user only has to operate the hand knob to adjust the position variably.

According to a preferred embodiment of the present disclosure, the first bearing block extends through an arcuate cutout of the inner side part and is guided and shifted in an elongated hole of the slider for variable adjustment of the position between a substantially horizontal position and an ergonomically seated position when the self-locking action of the hand knob is released.

It is also advantageous if the slider is guided in a guide of the inner side part, so that the movement of the slider is guided from two sides, thus facilitating self-locking.

In accordance with a preferred embodiment of the reclining device according to the disclosure, the locking slide is moved by actuating the hand knob in the locking recess, thereby releasing the self-locking effect, whereby wedging the locking slide in the locking recess creates the self-locking effect when the hand knob is no longer actuated by the user.

Furthermore, it is advantageous if the backrest element is supported between the right and left side parts so that it can rotate about a rotation axis, whereby the rotation axis and the first bearing block determines the position of the backrest element. This leads to a simple embodiment, where the horizontal lying position is defined by the axis of rotation and the uppermost position of the first bearing block, and where the second and third bearing blocks are also in their uppermost position.

In accordance with another preferred embodiment of the lying device according to the disclosure, a first bar, a second bar and a third bar are provided between the right and the left side parts for stabilization, which together form a triangle, and whereby the first and third bar form the base of the triangle and each represent the support of a wheel for rolling the lying device or for rolling the lying device over the floor.

Furthermore, it is advantageous if at least the right and the left side parts as well as the backrest element, the seat element and the footrest element are made of wood, since these parts of the device according to the disclosure can be manufactured in a simple and inexpensive way despite their conceptually extensive construction.

Furthermore, it is advantageous if at least the right and left side parts as well as the backrest element, the seat element and the footrest element are made of plastic, since these parts of the device according to the disclosure can be manufactured in a simple and cost-effective manner despite their extensive conceptual design.

In addition, it is advantageous if at least the right and left side parts as well as the backrest element, the seat element and the footrest element are made of metal, since these parts of the device according to the disclosure can be manufactured in a simple and cost-effective manner despite their extensive conceptual design.

Further advantageous embodiments of the lying device according to the disclosure can be found in the following figure description.

BRIEF DESCRIPTION OF THE DRAWINGS

Individual or all representations of the figures described in the following are preferably to be regarded as construction drawings, i.e., the dimensions, proportions, functional relationships and/or arrangements resulting from the figure(s) preferably correspond exactly or preferably substantially to those of the device or product according to the disclosure.

Further advantages, objectives and characteristics of the present disclosure are explained by means of the following description of the attached drawings, in which devices conforming to the disclosure are exemplarily shown. Elements of the devices and processes according to the disclosure, which are at least essentially identical in the figures with respect to their function, can be marked with the same reference signs, whereby these components or elements need not be numbered or explained in all figures. In the following, the disclosure is described purely as an example by means of the attached figures.

DETAILED DESCRIPTION

In the following, various aspects of the disclosure are explained using the figures.

Figure 1:
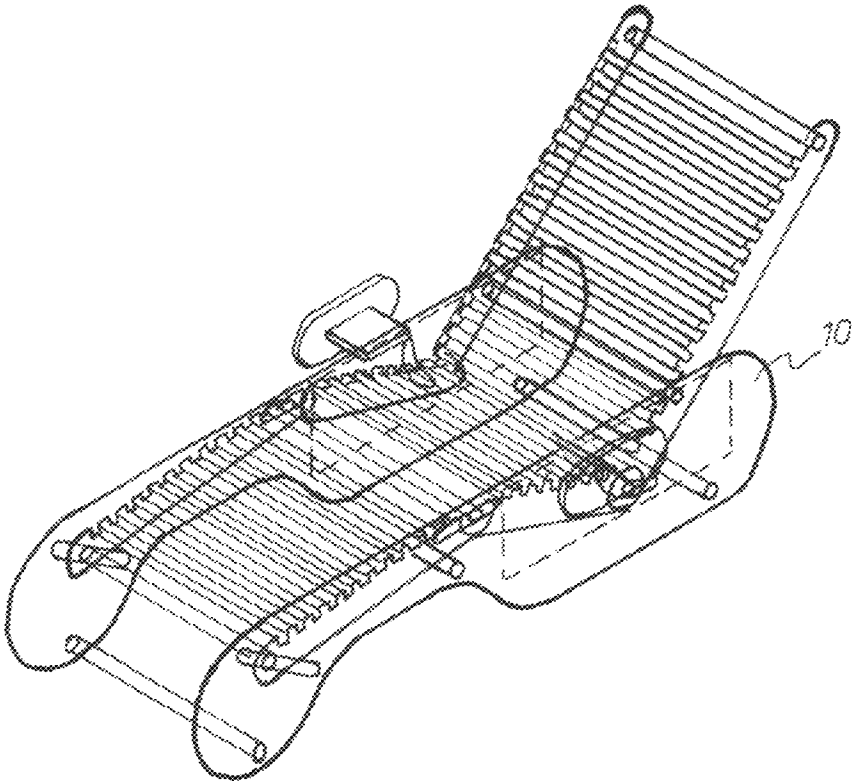
FIG. 1 shows a perspective view of the lying device according to the disclosure.

FIG. 1 shows a perspective schematic overall view of the couch device 10 according to the disclosure with rungs 140 (see FIG. 6) of the ergonomic couch, in which the outer 60 (see FIG. 5) and inner 80 (see FIG. 5) side parts are shown transparently. Not shown are the reinforcements (wooden slats) 160 (see FIG. 7), which are glued onto the side parts 90/130 (see FIG. 5) (detail 150, see FIG. 6) (see FIG. 7) after inserting the rungs 140 (see FIG. 6) into the notches 98 (see FIG. 6) of the side parts 901130 (see FIG. 5) (detail 150, see FIG. 6) to guarantee the strength (prevention of bending fracture due to excessive load) of the back rests.

Figure 2:
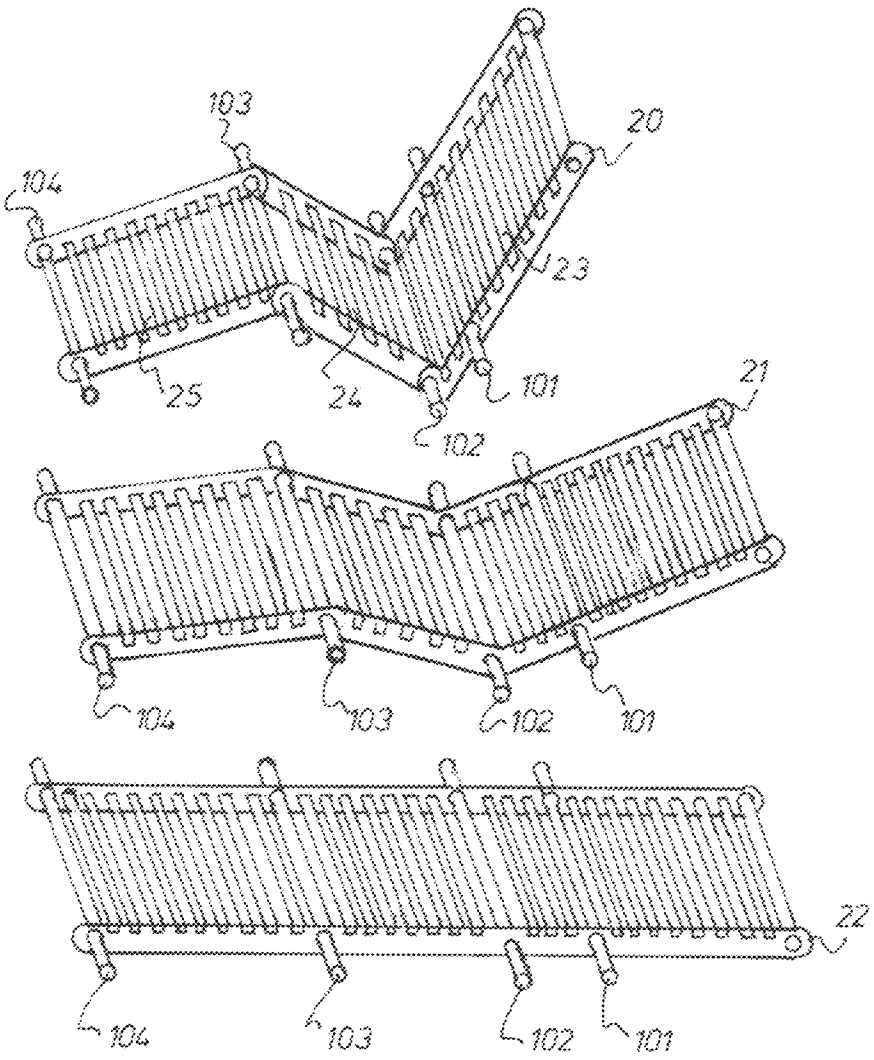
FIG. 2 schematically different positions of the lying device of FIG. 1.
Figure 5:
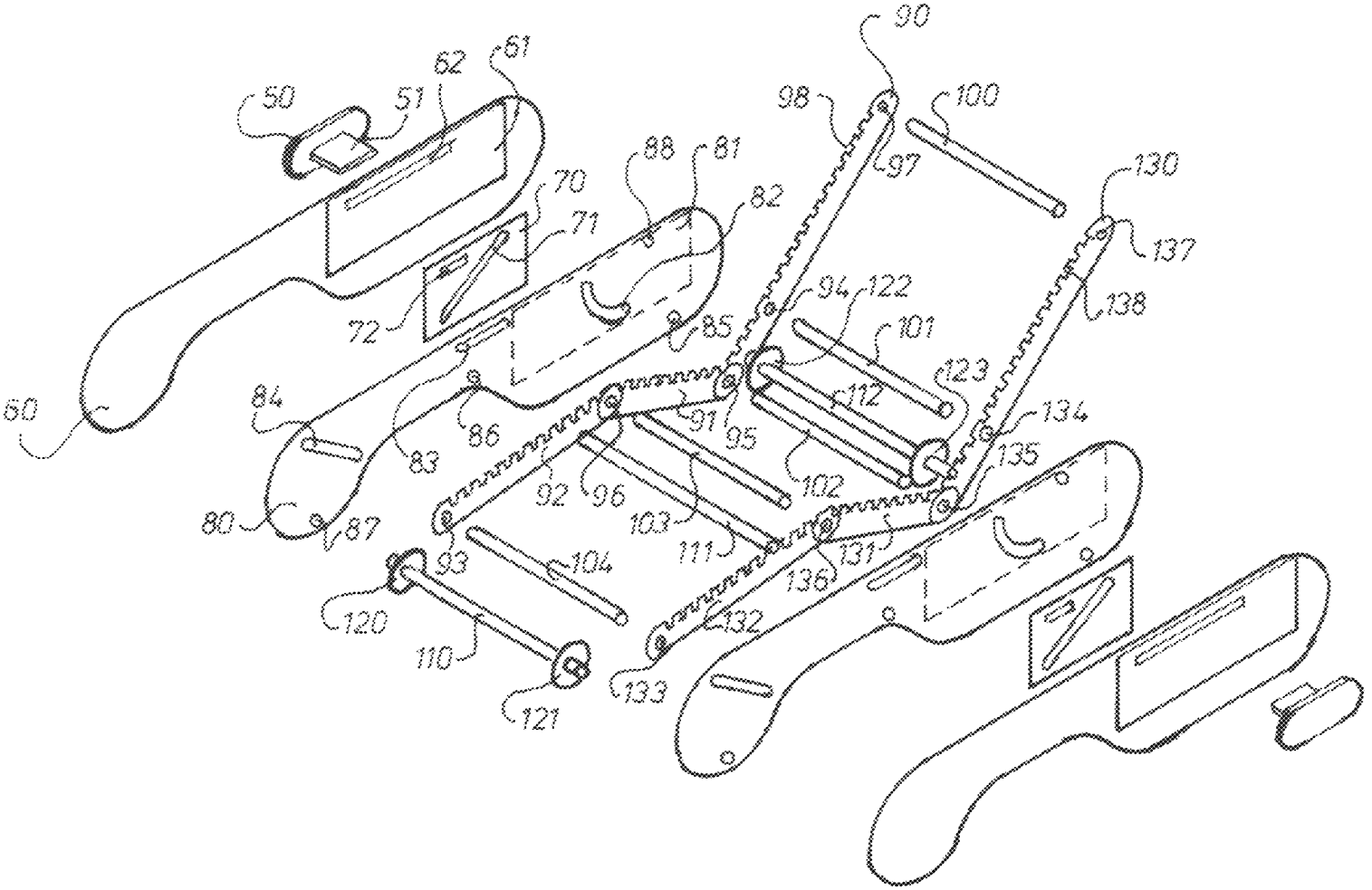
FIG. 5 an exploded view of the lying device of FIG. 1.

FIG. 2 shows a perspective view of the already assembled lying surfaces (backrest 23, seat 24 and footrest 25) in different positions (but without the interaction between outer 60 (see FIG. 5) and inner 80 (see FIG. 5) side parts and slide 70 (see FIG. 5). The seat position 20 is shown with the back section 23 raised, the seat section 24 lowered and the footrest 25 angled. The semi-recumbent position 21 is shown with inclined backrest 23, half-raised seat 24 and half-raised footrest 25. The lying position 22 is shown with horizontal backrest 23, horizontal seat 24 and horizontal footrest 25. Any position between these extremes can be adjusted and is held in this position by means of the self-locking function described below. Only by the interaction of the lying surfaces with the guides in the inner side parts 80 (see FIG. 5) of the couch and the simultaneous inhibition of the movement by means of the bearing block 102 (see FIG. 5) in the long hole 71 (see FIG. 5) of the slider 70 (see FIG. 5) and its simultaneous jamming in its guide (cutout 61 (see FIG. 5) in the outer side panel 60 (see FIG. 5) and cutout 81 (see FIG. 5) in the inner side panel 80 (see FIG. 5) this functionality can be achieved. When the upper part of the backrest 23 is loaded by leaning the person against the backrest 23 and the seat 24 is relieved at the same time—person stretches, the torque created at the bearing block 101 (see FIG. 5) exerts a thrust on the seat 24 by means of a lever action via the articulated connection between backrest 23 and seat 24 (bearing block 102 (see FIG. 5)). This in turn is transmitted to the foot section 25 via the link between seat 24 and foot section 25 (bearing block 103 (see FIG. 5)) and ensures that the foot section 25 is lifted at the open end with bearing block 104 (see FIG. 5) (by the skew 84 in the inner side panel 80 (see FIG. 5). This is only possible when the slider 70 (see FIG. 5) is simultaneously actuated by the lateral knob 50/51 (see FIG. 9*a*) to release the self-locking mechanism.

The self-locking effect is created by the interaction of the following components: bearing block 102 (see FIG. 5), an arc-shaped or circular cutout 82 (see FIG. 5), slider 70 with associated oblong hole 71 (see FIG. 5) and the hand knob 50/51 (see FIG. 5), as well as the milled guides or locking cutout 61 in the outer side panel 60 and the milled guide 81 in the inner side panel 80 (see FIG. 5).

The self-locking feature is based on the friction principle. This means that the slider 70 with its obliquely milled oblong hole 71 (see FIG. 5) is pressed either upwards or downwards by the bearing block 102 (see FIG. 5), depending on the load or relief of the seat surface. When the seat surface is loaded downwards, when it is unloaded, the load is directed upwards. This creates friction between these surfaces via the positive locking of the slider 70 (see FIG. 5) with the upper or lower edge of the milled recess 61 in the side panel 60 (see FIG. 5). Thus, the slider 70 (see FIG. 5) acts like two wedges that are directed against each other but connected to each other and clamp between the bearing block 102 (see FIG. 5) and the respective upper or lower edge of the recess 61 in the side part 60 (see FIG. 5). Thus, neither forward nor backward movement is possible after force closure of these components. Only when the bearing block 102 (see FIG. 5) is relieved of load, the slider 70 (see FIG. 5) can be moved again by means of the lateral knob 50/51 (see FIG. 5) or the armrest 180 (see FIG. 4) and the self-locking device can be released.

The self-locking is also functional if the principle is reversed 180 and the roles (active and passive) of the components are swapped. In other words, it is not the bearing pedestal 103 (active) that exerts a push/pressure movement on the slider 344 (passive), or as in FIGS. 16*c* and 16*d* on the slider 513 (passive) or slider 518 (passive), but vice versa—the slider 344 (active), or as in FIGS. 16*c* and 16*d* the slider 513 (active) or slider 518 (active) exert a push/pressure movement on the bearing pedestal 103 (passive). Generally, only the role (active and passive) of the components changes, but the basic principle remains the same. It only depends on the fact that for the respective reacting component (passive) (either slider or bearing block) a small "play" is constructively provided for to make the jamming possible.

This functionality distinguishes the present couch from many mechanical couch available on the market, since no action of the user is required to maintain the assumed position. In order to prevent the position taken by the user from changing automatically, the up and down movement of the bearing block 102 in the circular cut-out 82 (see FIG. 5) of the inner side part 80 (see FIG. 5) must be inhibited. This inhibition is achieved by the bearing block 102 reaching through the circular cutout 82 (see FIG. 5) into the oblong hole 71 (see FIG. 5) or 261 (see FIG. 4) of the slider 70 (see FIG. 5) or 260 (see FIG. 4). This long hole 71 (see FIG. 5) or 261 (see FIG. 4), which actually divides the slider 70 (see FIG. 5) or 260 (see FIG. 4) into two opposing wedges, blocks the free movement of the bearing block 102 (see FIGS. 4).5) in the—circular cutout 82 (see FIG. 5) due to the fact that the long hole 71 (see FIG. 5) or 261 (see FIG. 4) is almost always aligned transversely to the—circular direction of movement (up or down) of the bearing block 102 (see FIG. 5). The pressure (up or down) exerted by the bearing block 102 (see FIG. 4) via the oblong hole 71 (see FIG. 5) or 261 (see FIG. 4) on the slider 70 (see FIG. 5) or slider 260 (see FIG. 4) causes it to wedge with the upper (for upward movement) or lower edge (for downward movement) in the milled guide 61 (see FIG. 4) or 81 (see FIG. 5). The components are deliberately installed with a little "play" to make this jamming possible at all. Most of the friction is generated between the milled guides 61 or 81 (see FIG. 5) and the respective ends of the upper and lower edge of the slider 70 (see FIG. 5) or 260 (see FIG. 4).

As long as pressure is exerted by the bearing block 102 (see FIG. 4) on the slider 70 (see FIG. 5) or 260 (see FIG. 4) via the oblong hole 71 (see FIG. 5) or 261 (see FIG. 4) (e.g., by leaning against the backrest 23 (see FIG. 2) or by relieving the backrest and loading the seat 24 (see FIG. 2), the respective direction of movement is blocked. When changing the direction of movement of the bearing block 102 (see FIG. 4) and the resulting inevitable relief of the oblong hole 71 (see FIG. 5), the slider 70 (see FIG. 5) or 260 (see FIG. 4) can be moved freely until the bearing block 102 (see FIG. 5) again meets the opposite side of the oblong hole 71 (see FIG. 5) or 261 (see FIG. 4). Then, after a short jerk (caused by a change in load and renewed jamming of the slider), this direction of movement is blocked again. Only when the bearing block 102 (see FIG. 5) is relieved and the shutter 70 (see FIG. 5) or 260 (see FIG. 4) is simultaneously actuated by means of the lateral knob 50/51 (see FIG. 5) or the armrest 180 (see FIG. 4) can the self-blocking be released. As both sliders 70 (see FIG. 5) or 260 (see FIG. 4) are preferably moved simultaneously and both hands are required for this, the already low risk of injury due to a finger being caught in one of the guide cutouts 62, 82, 83, 84 (see FIG. 5) when adjusting the position is practically impossible. It is precisely these features that make this couch particularly attractive for use in the medical and therapeutic fields. The self-locking mechanism shown in FIGS. 16*a* and 16*b* differs only in that the direction of movement of the bearing block 103 (see FIG. 5) Is not transverse to the respective oblong hole in slide 344 (see FIG. 16*a*) and 345 (see FIG. 16*b*), but rather oblique. By shifting the self-locking mechanism from the rotating range of the bearing block 102 to the bearing block 103, the curved cutout 82 of the inner side panel 80 (see FIG. 5) can be omitted. The self-locking mechanism is now not generated by a circular movement, but by a push/pull movement of the bearing block 103 onto slide 344 or, as shown in FIGS. 16*c* and 16*d*, onto slide 513 or slide 518.

There is generally the possibility of symmetrical self-locking with blocking in both directions of movement (with parallel flanks of the slanting slot (71, 261, 271, 281, 291, 301) in the slider (70, 260, 262, 270, 280, 290, 300, 321, 331, 344, 513, 518)) or asymmetrical self-locking with blocking in only one direction of movement with the preferred blocking/sliding direction, which is characterized by different angles of the slot (71, 261, 271, 281, 291, 301) in the slide (70, 260, 262, 270, 280, 290, 300, 321, 331, 344, 513, 518) for push/pull direction. This means that the two flanks of the slot are not parallel, but have different slopes. In blocker direction (leaning against the backrest), a flat angle is used to set the friction to maximum or as required for the application. In the opposite sliding direction (straightening up from the sitting position) a steep angle is used to set the friction to a minimum or as required for each application. This results in an asymmetrical motion sequence which allows full braking in one direction (self-locking) and maximum sliding in the opposite direction (very little or no self-locking).

Figure 3:
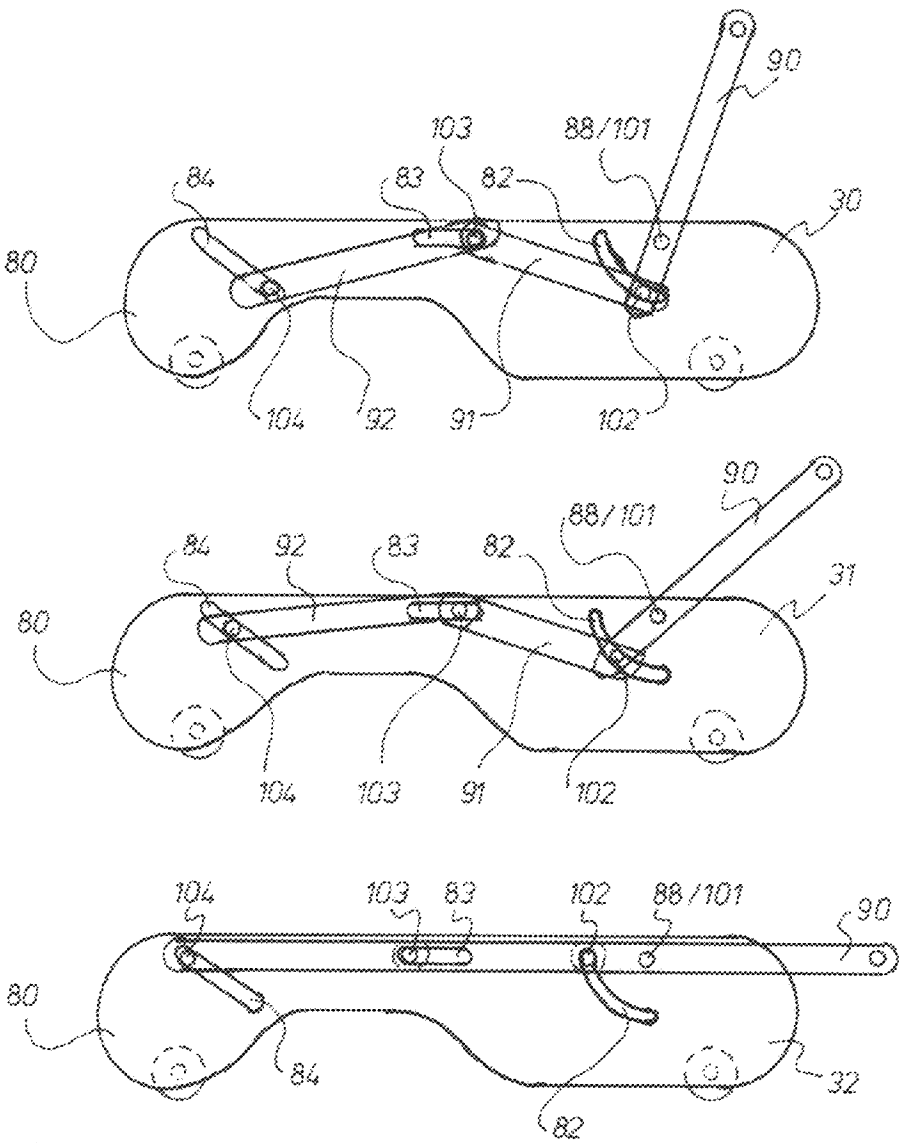
FIG. 3 schematically different positions of the lying device of FIGS. 1 and 2 in a side view.

FIG. 3 shows a lateral section through the couch with transparently displayed components in order to schematically illustrate this interaction of the aforementioned components in the three different positions (but without the interaction with the slider 70 (see FIG. 5). The seat position 30, the semi-recumbent position 31 and the horizontal reclining position 32. FIG. 3 shows very clearly how the lever position of the backrest (in this case, side section-backrest 90 (see FIG. 3)) changes over the three positions. 5), which changes via the pivot axis in hole 88 (see FIG. 5) in the inner side panel 80 (see FIG. 5) or the bearing block 101 (FIG. 5), the link between backrest 23 (see FIG. 2) and seat 24 (see FIG. 2). This is made possible by the circular cutout 82 (see FIG. 5) in the inner side panel 80 (see FIG. 5) which enables the free run of the bearing block 102 (see FIG. 5) in it. The oblong hole 83 in the inner side panel 80 (see FIG. 5) serves on the one hand as bearing for the hinge connection (bearing pedestals 104 (see FIG. 5)) between seat 24 (see FIG. 2) and foot section 25 (see FIG. 2) and on the other hand as guide for the latter. The same applies to the oblique long hole 84 (see FIG. 5) in the inner side panel 80 (see FIG. 5) and the bearing block 104 (see FIG. 5) of the foot section 25 (see FIG. 2). The movement of the lying surfaces in the opposite direction is achieved by relieving the load on the backrest 23 (see FIG. 2) by tensing the abdominal muscles in the lying surface and straightening up, exerting pressure on the seat surface 24 (see FIG. 2) or the lower part of the backrest 23 (see FIG. 2) (below the pivot point 88/101 (see FIG. 5)) and relieving the load on the upper part of the backrest 23 (see FIG. 2) (above the pivot point 88/101 (see FIG. 5)). Here too, this is only possible if knob 50/51 (see FIG. 5) is actuated simultaneously to overcome the self-locking effect. This applies to symmetrical self-locking. In the case of asymmetrical self-locking, movement is only blocked when leaning back and not when straightening up.

Figure 4:
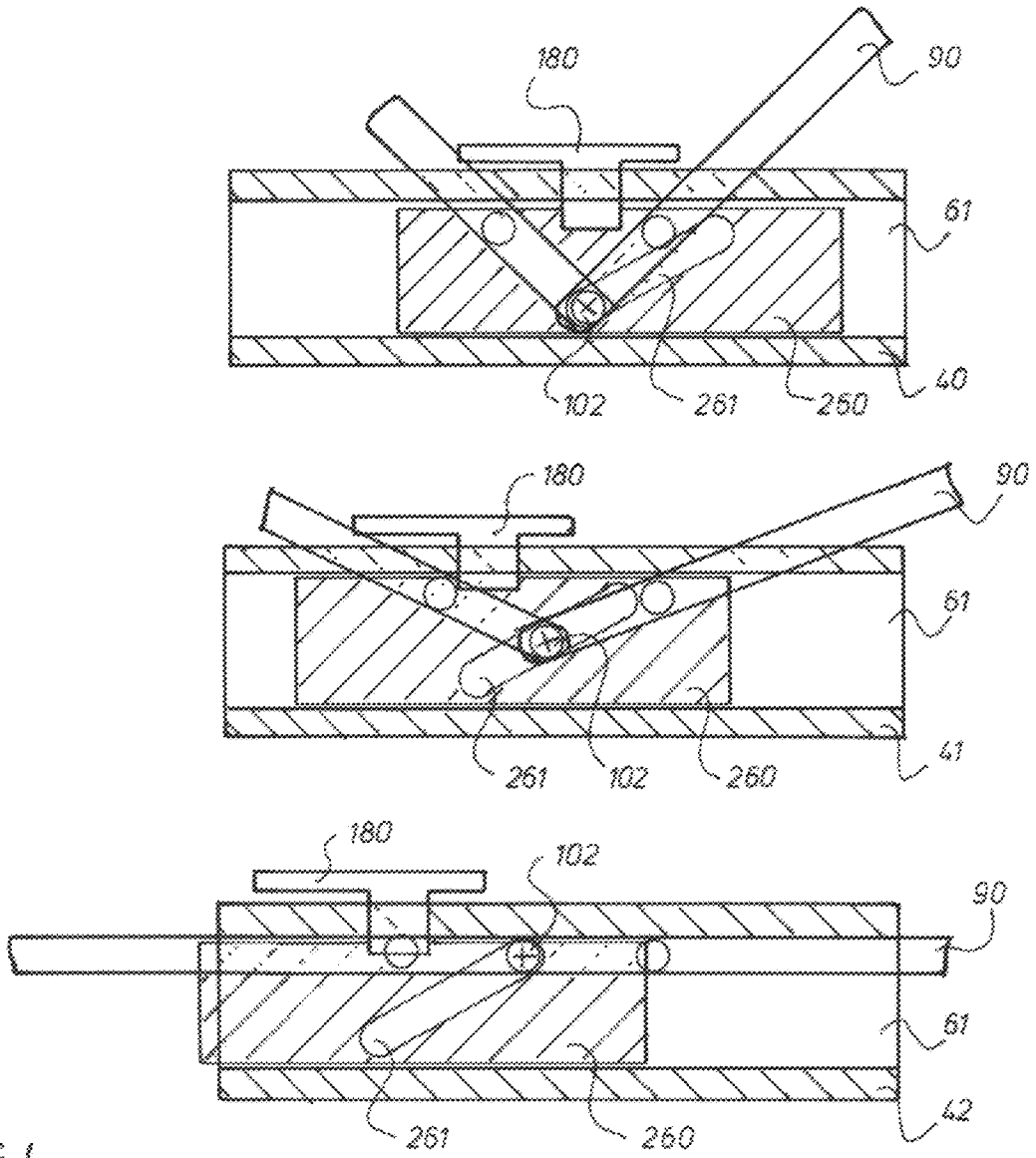
FIG. 4 schematically a detailed section of FIG. 3.
Figure 9A:
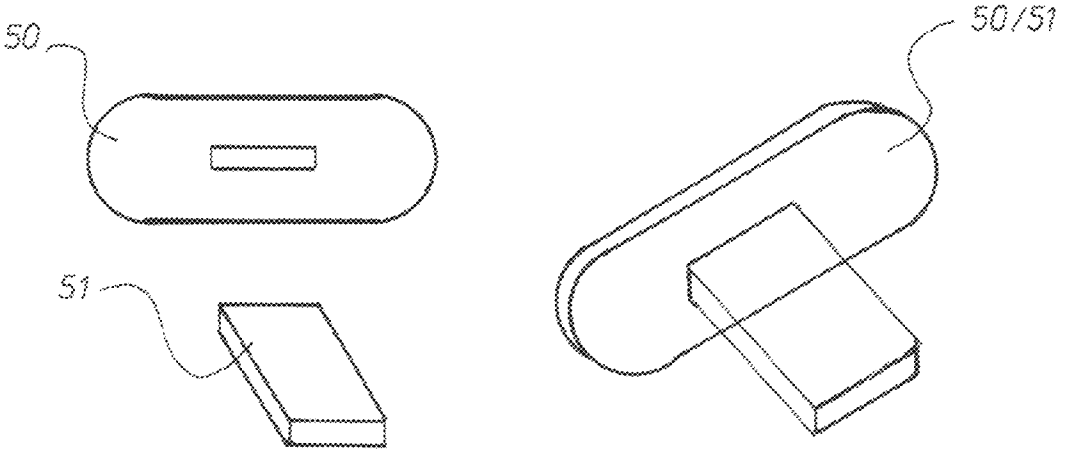
FIG. 9*a*-9*e* detailed views of embodiments of the lying apparatus according to the disclosure.
Figure 9B:
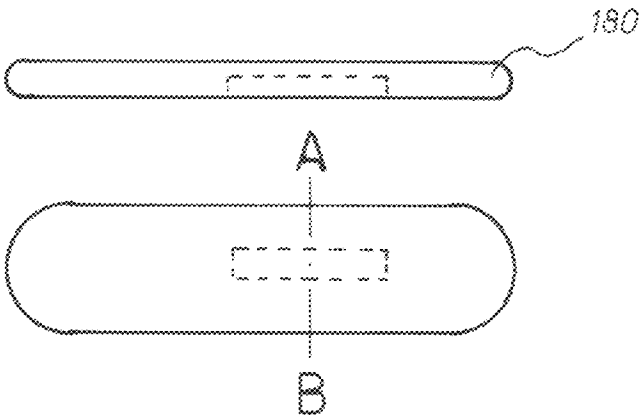

FIG. 4 also shows a lateral section through the couch with transparently displayed components in order to schematically illustrate the interaction of the previously mentioned components in the three different positions, but is limited to the representation of the variant of the slider 260 (see FIG. 11*b*), a section of the alternative outer side part 210 (see FIG. 10*b*) with the cutout 211 (see FIG. 10*b*), the lateral view of the couch frame and the section through the armrest 180 (see FIG. 9*b*). Also shown here are the three main positions Sitting 40, Semi-Lying 41 and Lying 42. You can see very clearly how the slider 260 (see FIG. 11*b*) moves from right to left when moving from the sitting position 40 to the semi-recumbent position 41 and finally to the horizontal lying position 42. You can also see how the bearing block 102 (see FIG. 5) In the inclined hole 261 (see FIG. 11*b*) moves from below (seat position 40), via the semi-recumbent position 41 (centered) upwards to the lying position 42, thus moving the seat 24 (see FIG. 2) from the inclined position to the horizontal. Of course, the pivot bearing 88/102 (see FIG. 5) remains unchanged, but the joint connection between seat 24 (see FIG. 2) and foot section 25 (see FIG. 2) moves horizontally in its guide long hole 83 (see FIG. 5). The armrest 180 (see FIG. 9*b*) is always pushed away from itself by the user of the couch when the user stretches, if the user relieves the slide 260 (see FIG. 11*b*) via the articulated connection (bearing block 102 (see FIG. 5)) by relieving the load on the seat 24 (see FIG. 2) and simultaneously loading the backrest 23 (see FIG. 2) above the pivot point 88 (see FIG. 5), thus releasing the self-locking effect. After reaching the new desired position, the user relaxes and briefly releases the armrest 180 (see FIG. 9*b*) and the slider 280 (see FIG. 11*b*) wedges in its guide 211 (see FIG. 10*b*) in the new position due to the pressure of the bearing block 102 (see FIG. 5) in the long hole 281 (see FIG. 11*b*). In the opposite direction, the user of the couch simply tenses the abdominal muscles and simultaneously pulls the arm rests 180 (see FIG. 9*b*). The mechanism is moved in the same way as before, but in the opposite direction, and the user moves from the lying position 42 via the semi-seated position 41 back to the seated position 40. This applies to symmetrical self-locking. In the case of asymmetrical self-locking, the movement is only blocked when leaning back and not when straightening up.

FIG. 5 shows a schematic exploded view of the couch with all individual parts relevant for the function (provided with numbers and, for clarity, without rungs 140 (see FIG. 6) and reinforcements (wooden slats) 160 (see FIG. 7) of the backrest side parts 90/130 (see FIG. 5).

The individual parts are described below and the detailed views of FIGS. 6 to 15*b* are explained in their function.

Figure 6:
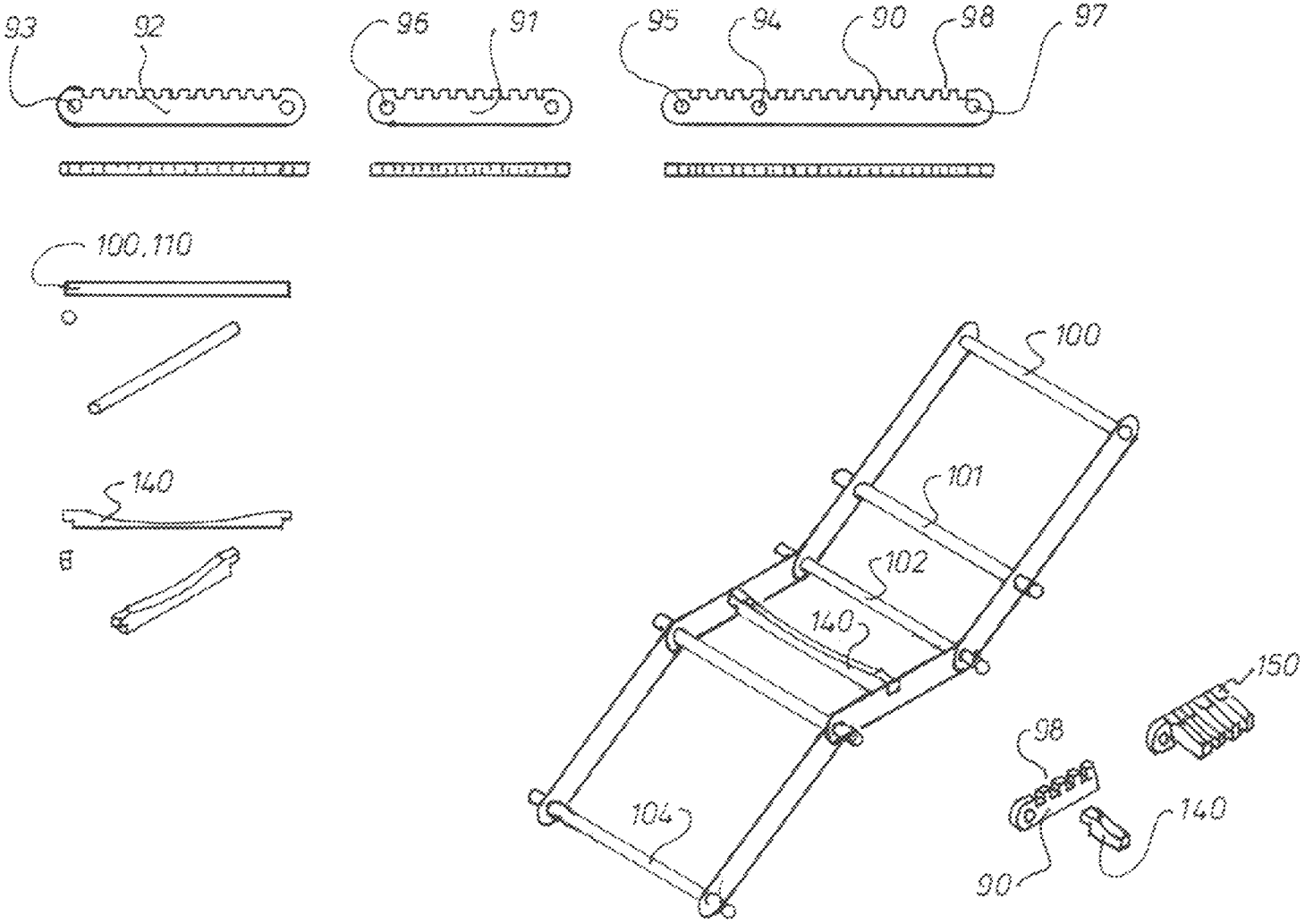
FIG. 6 a detailed view of the lying device according to the disclosure.

FIG. 6 shows the perspective view of the lying surface frame with back, seat and foot sections as well as the respective individual parts with omission of the entire rungs 140, whose insertion into the recess 98 (see FIG. 5) of the side part 90 (see FIG. 5) is shown schematically as a joined section 150. The individual parts 90, 91, 92 are shown in side view and top view. The bearing blocks are shown as an example using 100, 110 in perspective. The rungs 140 are also shown in side view and top view and in perspective.

Figure 7:
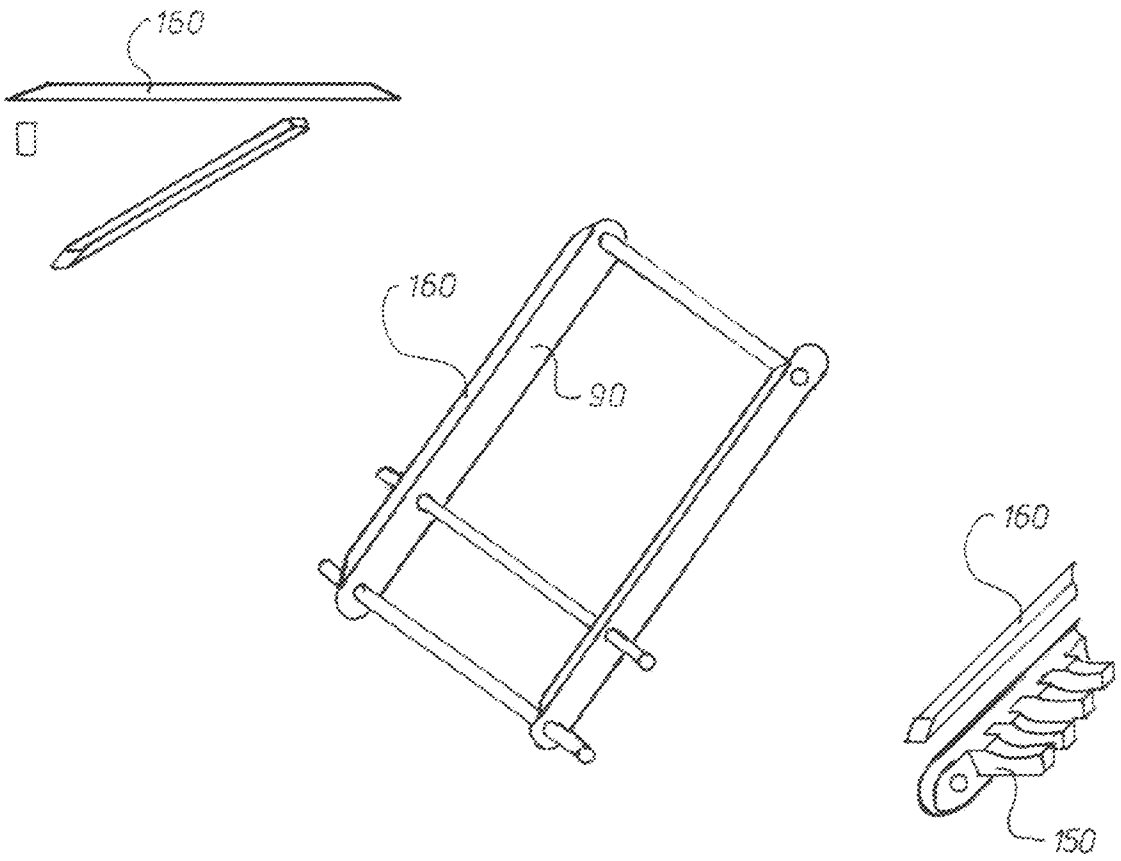
FIG. 7 a detailed view of a back part of the lying device according to the disclosure FIG. 8 a detailed view of the side parts of the lying apparatus according to the disclosure.

FIG. 7 shows the reinforcement 160 in side, top and perspective view. Also shown is the reinforcement 160 in conjunction with the side section 90 of the backrest 23 (see FIG. 2). A detailed view shows the joining of the reinforcement 160 using wood glue with the cutout 150 (see FIG. 6).

Figure 8:
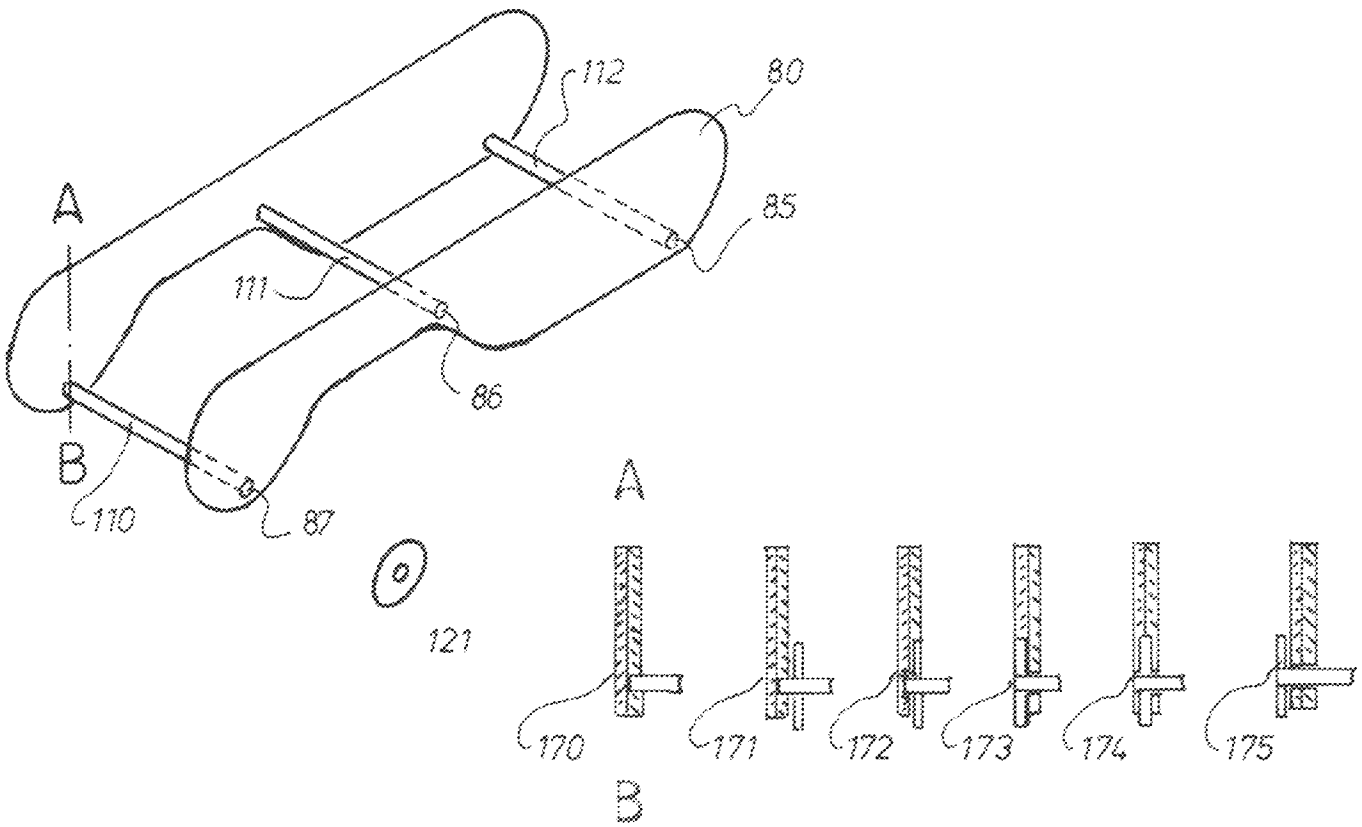

FIG. 8 shows a simplified perspective of the static construction, where the round bars 110, 111, 112 between the inner side parts 80 each form an imaginary triangle, which ensures the lateral stability of the couch. An example of this is a wheel 121, which, when pushed over the rods 110 and 112 (one wheel on the left and one on the right), offers the possibility of easier mobility of the couch. The possible variants without wheel 170, with wheel 171 or different variants of the wheel suspension 172, 173, 174 and 175 are also shown as sections A/B.

FIG. 9*a* shows the side-mounted actuation knob 50/51 for the slider 70 (see FIG. 5) as individual parts 50 (knob) and connecting part 51 for insertion in the slot 72 (see FIG. 5) of the slider 70 (see FIG. 5) and perspectively as a joined view.

FIG. 9*b* shows the armrest 180 for the operation of the slider 260 (see FIG. 11*b*) as side and top view and as section AB with the recess for the insertion of the connecting webs 262 (see FIG. 11*b*).

Figure 9C:
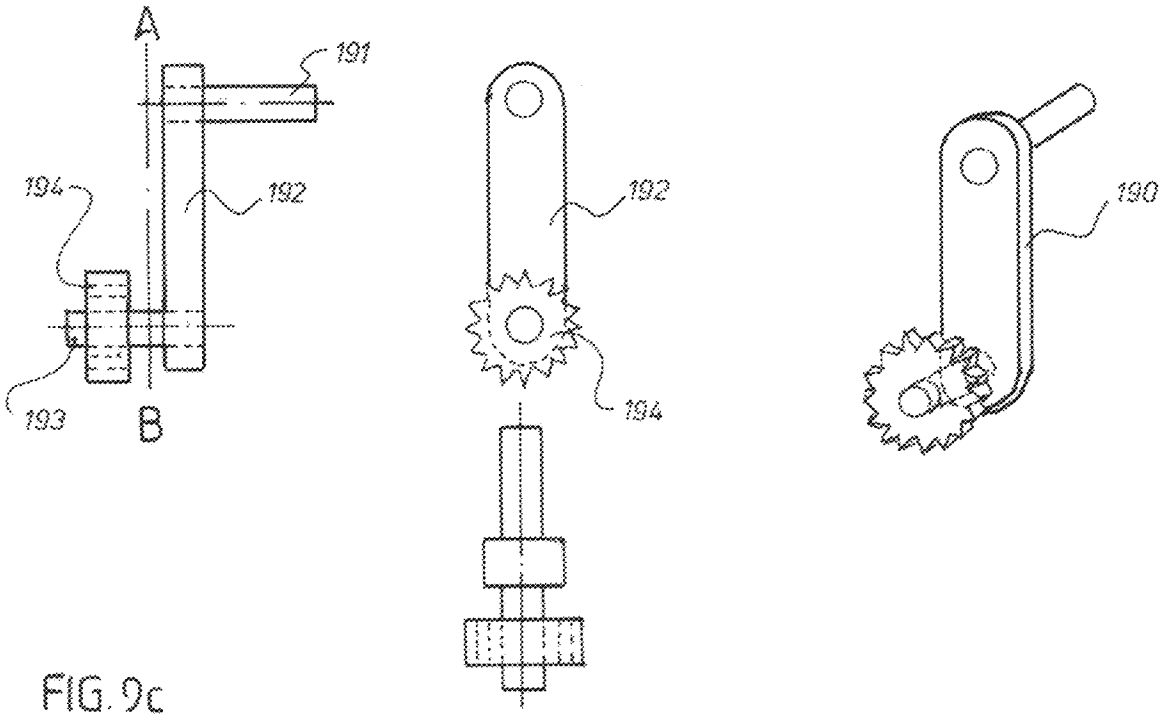

FIG. 9*c* shows the crank 190 for the alternative actuation of the modified slider 270 (see FIG. 11*c*) with toothing 272 (see FIG. 11*c*) with the individual parts crank handle 191, crank center post 192, crankshaft 193 and gear 194.

Figure 9D:
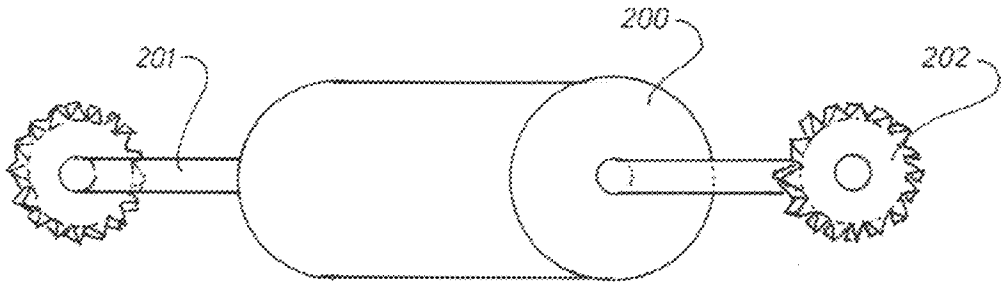

FIG. 9*d* shows a motor 200, the motor shaft 201 and the corresponding pinion 202 for the alternative actuation of the modified slider 270 (see FIG. 11*c*) with toothing 272 (see FIG. 11*c*).

Figure 9E:
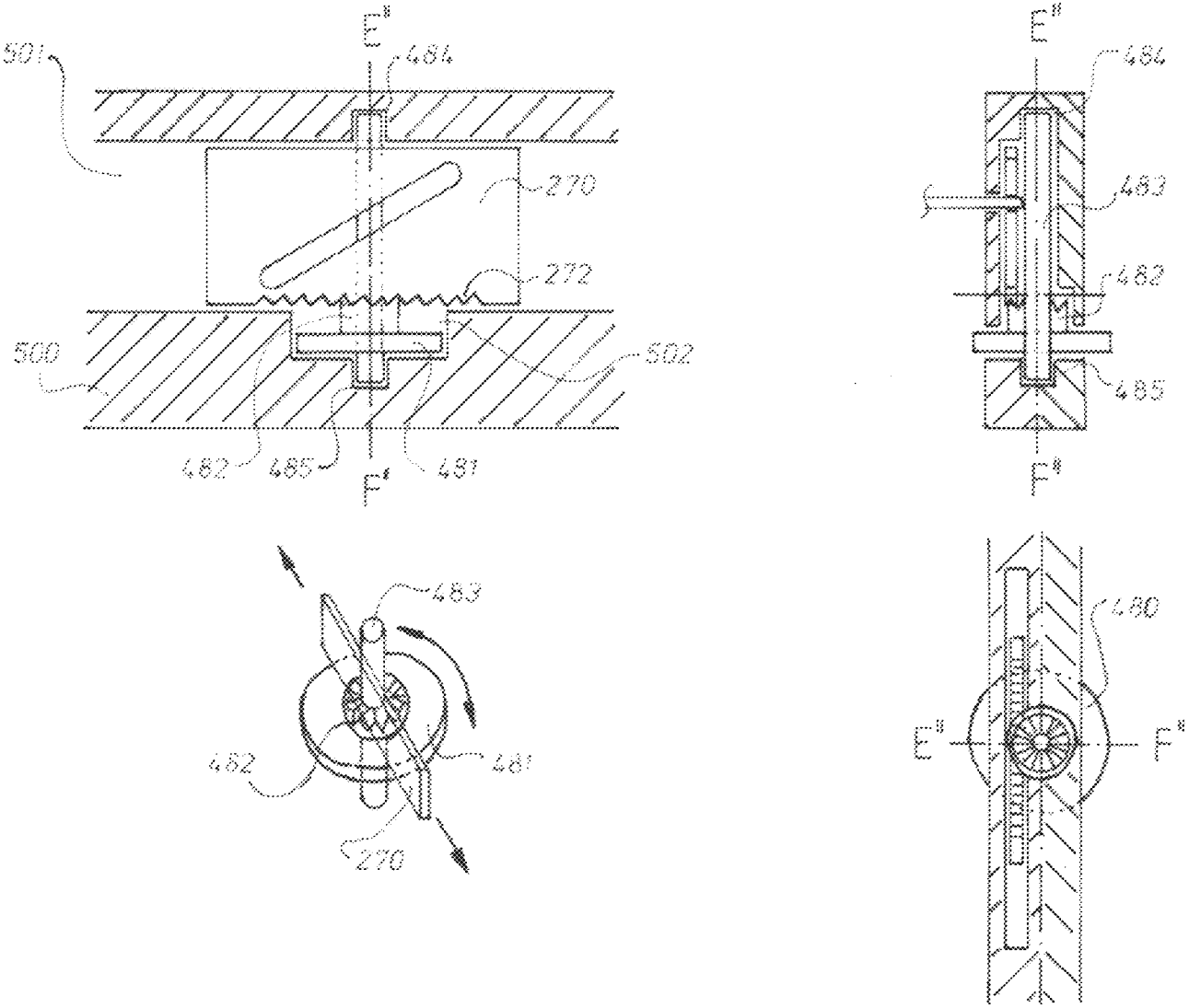

FIG. 9*e* shows the handwheel 480 (horizontal—also possible vertically) for the alternative actuation of the modified slider 270 (see FIG. 11*c*) with toothing 272 (see FIG. 11*c*) with the individual parts turntable 481, gearwheel 482, shaft 483, upper bearing bushing in the side part 484, lower bearing bushing in the side part 485, with the cutout 501 for the slider 270 and the cutout 502 for the turntable 481 in the outer side part 500. In this case, a motorized drive of the shaft 483 (not shown in the figure) is also possible.

Figures 10A, 10B, 10C:
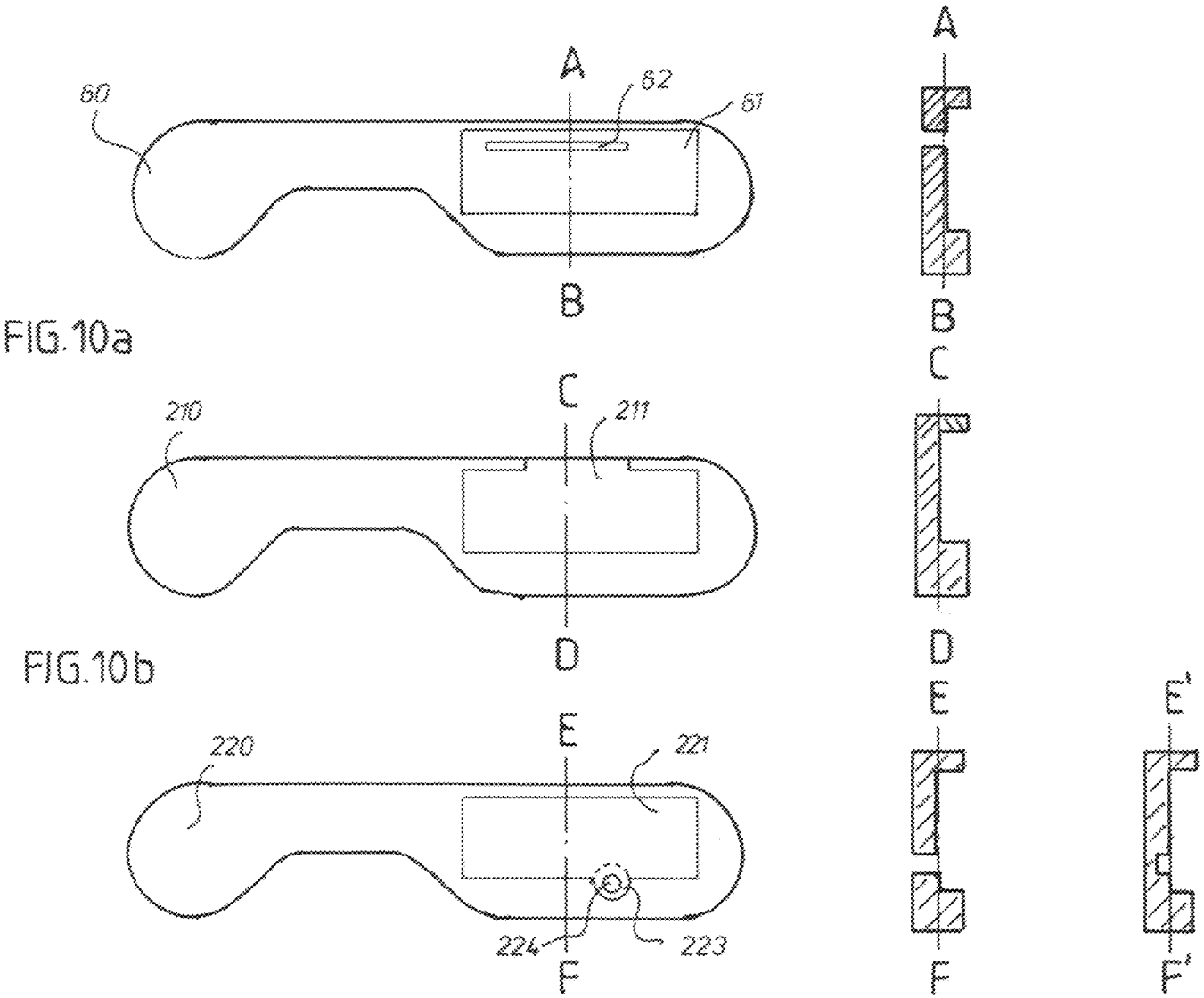
FIG. 10*a*-10*g* detailed views of embodiments regarding the side parts of the lying device according to the disclosure FIG. 11*a*-11*f* Detailed views of embodiments with regard to slides of the lying device according to the disclosure.

FIG. 10*a* shows the outside side panel 60 with the milled cutout 61 as guide for the slider 70 (see FIG. 5) and the slot 62 for receiving the connecting part 51 of the actuation knob 50/51 (see FIG. 9*a*) as well as the cut A/B for actuation by the lateral knob 50/51 (see FIG. 9*a*).

FIG. 10*b* shows the outside side panel 210 with the milled recess 211 as guide for the slider 260 (see FIG. 11*b*) and the recess for receiving the connecting piece 262 (see FIG. 11*b*) as well as the cut C/D for actuation by the armrest 180 (see FIG. 9*b*).

FIG. 10*c* shows the outside side panel 220 with the cutout 221 for the location of the slider 270 (see FIG. 11*c*) and the cutout 223 for the freewheel of the gearwheel 194 (see FIG. 9*c*) or the pinion 202 (see FIG. 9*d*) and the bearing hole 224 for receiving the crankshaft 193 (see FIG. 9*c*) or motor shaft 201 (see FIG. 9*d*) as well as the cutout E/F for actuation by the crank 190 (see FIG. 9*c*) and E'/F' by the motor 200 (see FIG. 9*d*).

Figure 10D:
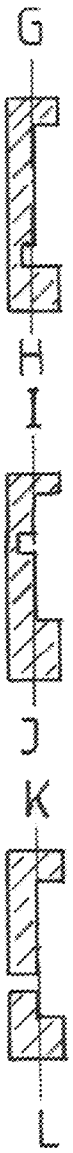
Figure 10D:
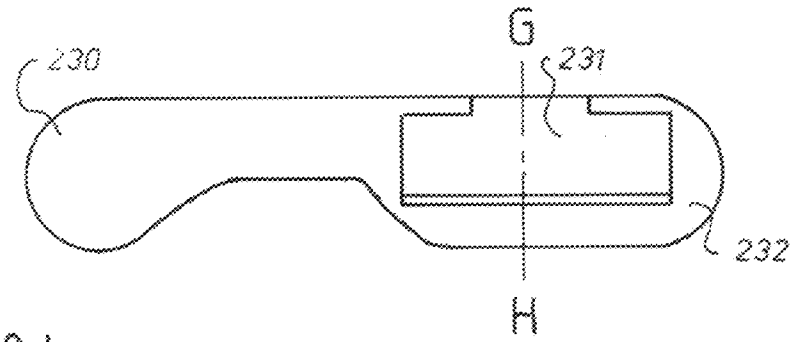

FIG. 10*d* shows the outside side panel 230 with the cutout 231 for the location of the slider 280 (see FIG. 11*d*) and the cutout 232 for the location of the crossbar 282 (see FIG. 11*d*) of the slider 280 (see FIG. 11*d*) as well as the cut G/H for actuation by the armrest 180 (see FIG. 9*b*).

Figure 10E:
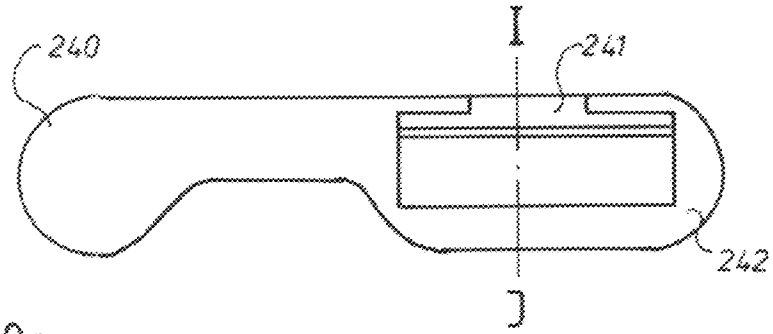

FIG. 10*e* shows the outside side panel 240 with the cutout 241 for the location of the slider 290 (see FIG. 11*e*) and the cutout 242 for the location of the crossbar 292 (see FIG. 11*e*)

of the slider 290 (see FIG. 11*e*) as well as the cut I/J for actuation by the armrest 180 (see FIG. 9*b*).

Figure 10F:
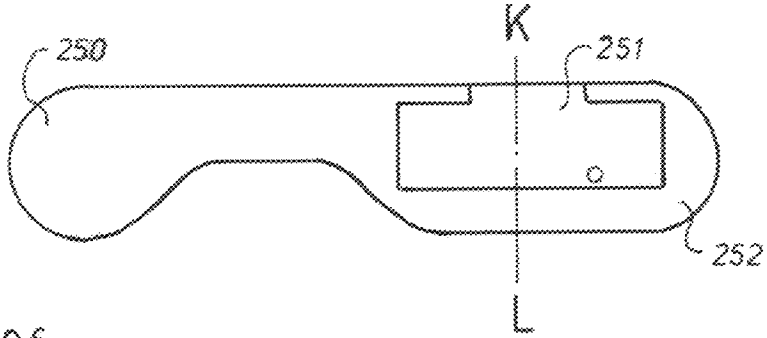
Figure 10G:
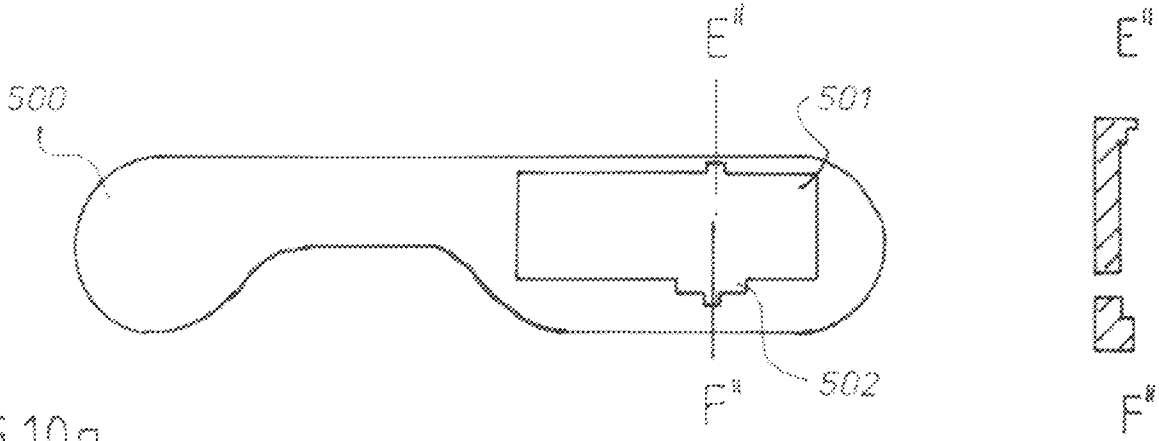

FIG. 10*g* shows the outside side part 500 with the cutout 501 for the location of the slider 270 (see FIG. 11*c*) and the cutout 502 for the freewheel of the turntable 481 (see FIG. 9*e*) or the upper and lower bearing bush in the side part 484/485 (see FIG. 9*e*) as well as the cut E"/F" for the actuation by the turntable 481 (see FIG. 9*s*).

FIG. 10*f* shows the outside side part 250 with the cutout 251 for the location of the slider 300 (see FIG. 11*f*) and the hole 252 for the location of a cross pin (bolt) as connection between the slot 302 (see FIG. 11*f*) of the slider 300 (see FIG. 11*f*) and the outside side part 250 as well as the cut K/L for the actuation by the arm rest 180 (see FIG. 9*b*).

FIG. 11*a* shows the design of the slider 70 with slanted long hole 71 and the recess 72 for receiving the connector 51 (see FIG. 9*a*) of the lateral actuation knob 50/51 (see FIG. 9*a*) as well as the cut AB.

FIG. 11*b* shows the design of the slider 260 with slanted long hole 261, the connecting web 262 and the long hole 263 for the connection to the armrest 180 (see FIG. 9*b*) as well as section C/D.

FIG. 11*c* shows the design of the slider 270 with slanted long hole 271 and the slider with toothing 272 for actuation by a gear wheel (194 (see FIG. 9*c*) or 202 (see FIG. 9*d*)) as well as the cut E/F.

FIG. 11*d* shows the design of the slider 280 with slanted oblong hole 281, the crossbar 282, the connecting bar 283 and the oblong hole 284 for the connection to the armrest 180 (see FIG. 9*b*) as well as the section G/H.

FIG. 11*e* shows the version of the slider 290 with slanted long hole 291, the crossbar 292, the connecting bar 293 and the long hole 294 for the connection to the armrest 180 (see FIG. 9*b*) as well as the section I/J.

FIG. 11*f* shows the version of the slider 300 with inclined long hole 301, the slot 302, the connecting bar 303 and the long hole 304 for the connection to the armrest 180 (see FIG. 9*b*) as well as the cut K/L.

Figure 12A:
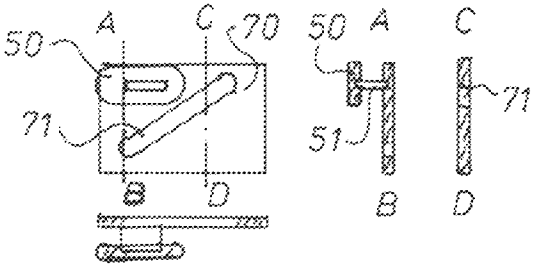
FIG. 12*a*-12*e* Detailed views of embodiments with regard to the operation of the slides of the lying apparatus according to the disclosure.

FIG. 12*a* shows the completely assembled unit of the lateral actuation knob 50/51 (see FIG. 9*a*) and the slider 70 (see FIG. 5) in side and top view as well as with the cuts A/B and C/D.

Figure 12B:
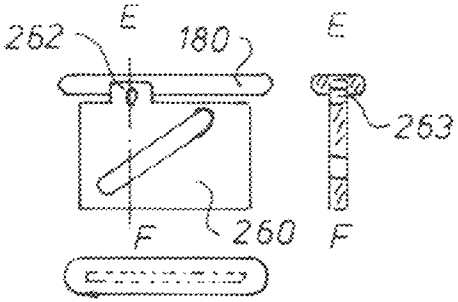

FIG. 12*b* shows the completely assembled unit of the actuation by the armrest 180 (see FIG. 9*b*) and of the slider 260 (see FIG. 11*b*) which are connected via the connecting web 262 and by a bolt to the oblong hole 263 in side and top view as well as with the cuts E/F.

Figure 12C:
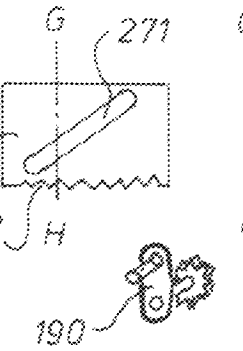

FIG. 12*c* shows the completely assembled unit of the operation by hand crank 190 (see FIG. 9*c*) and slider 270 (see FIG. 11*c*) in side view, as well as section G/H.

Figure 12D:
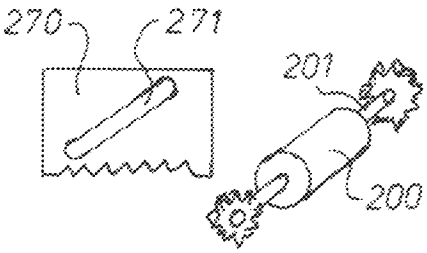

FIG. 12*d* shows the completely assembled unit for actuation by motor 200 (see FIG. 9*d*) and shutter 270 (see FIG. 11*c*) in side view.

Figure 12E:
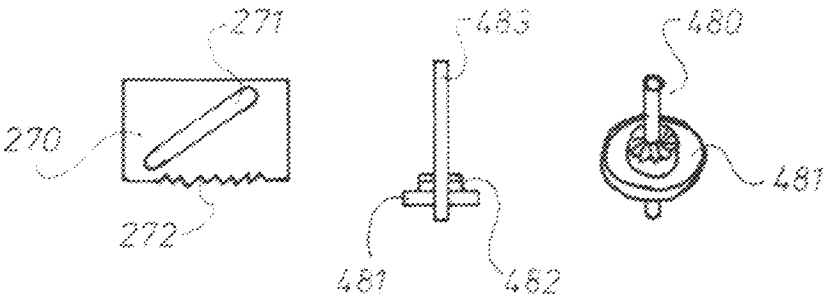

FIG. 12*e* shows the completely assembled unit for actuation by a handwheel 480 with the individual parts turntable 481, gear 482 and shaft 483 (see FIG. 9*e*) as well as the shutter 270 (see FIG. 11*c*) in side view.

Figure 13A:
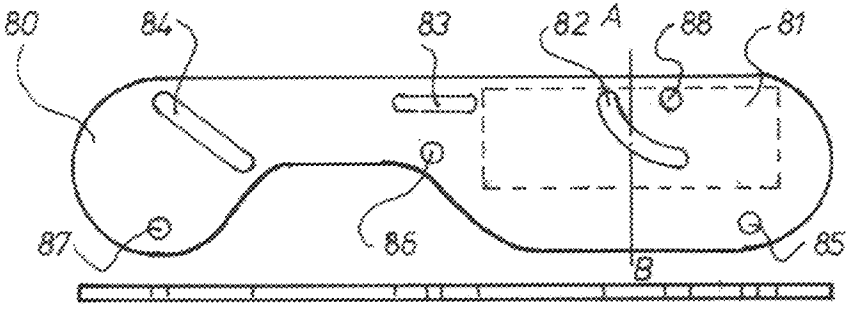
FIG. 13*a*-13*d* Detailed views of embodiments of the inner side parts of the lying apparatus according to the disclosure.

FIG. 13*a* shows an inner side panel 80 with all bores 85, 86, 87, 88, the oblong holes 83, 84, the arc milling 82 (for the free wheeling of the bearing block 102 (see FIG. 5)) and the surface milling 81 to accommodate the slider 70 (see FIG. 5) as guide, in side and top view as well as section A/B (for lateral operation by knob 50/51 (see FIG. 9*a*)).

Figure 13B:
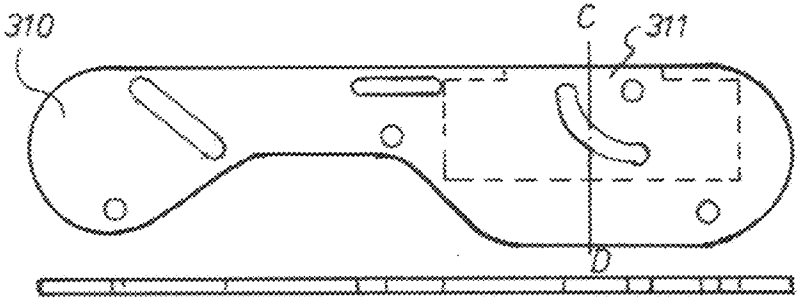

FIG. 13*b* shows an inner side panel 310 with all drill holes 85, 86, 87, 88, the oblong holes 83, 84, the curved cutout 82 (for the freewheel of the bearing block 102 (see FIG. 5) and the surface cutout 311 to accommodate the slider 260 (see FIG. 11*b*) as a guide, in side and top view as well as section C/D (for operation by armrest 180 (see FIG. 9*b*).

Figure 13C:
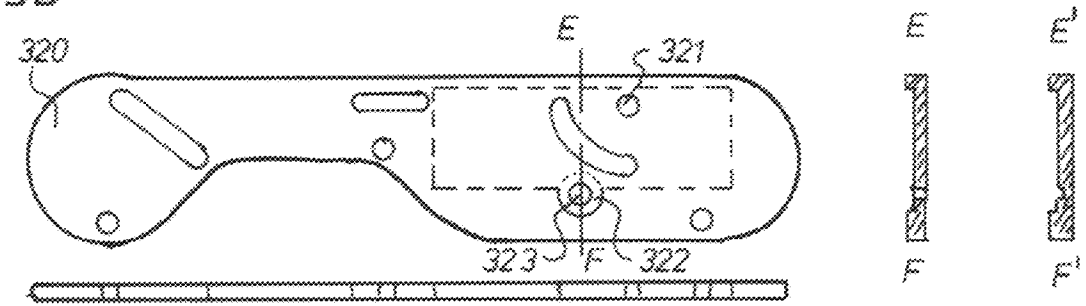

FIG. 13*c* shows an inner side panel 320 with all bores 85, 86, 87, 88, the oblong holes 83, 84, the curved cutout 82 (for the freewheel of the bearing block 102 (see FIG. 5)) and the surface cutout 321 to accommodate the slider 270 (see FIG. 11*c*) as guide, and the cutout 322 for the freewheel of the gearwheel 194 (see FIG. 9*c*) or the pinion 202 (see FIG. 9*d*) and the bearing hole 323 for receiving the crankshaft 193 (see FIG. 9*c*) or motor shaft 201 (see FIG. 9*d*) in side and top view as well as the cuts E/F and E'/F' (for actuation by crank 190 (see FIG. 9*c*) and E'/F' by motor 200 (see FIG. 9*d*).

Figure 13D:
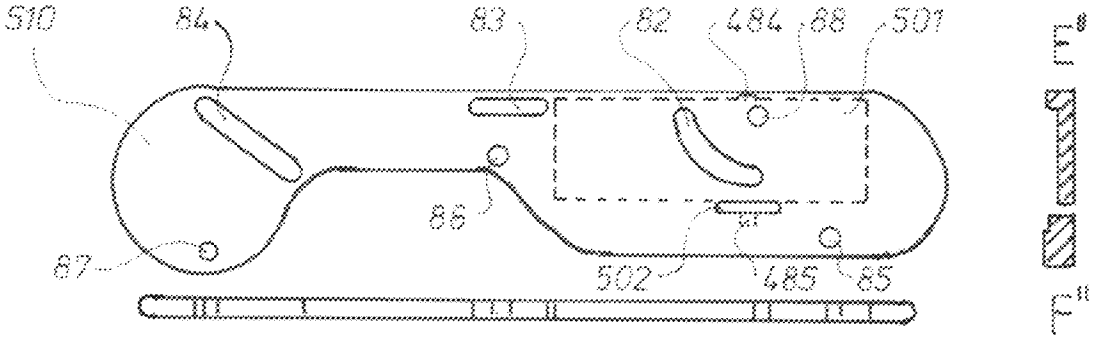

FIG. 13*d* shows an inner side panel 510 with all holes 85, 86, 87, 88, the slotted holes 83, 84, the curved routing 82 (for the freewheel of the bearing block 102 (see FIG. 5)) and the surface routing 501 for the attachment of the slider 270 (see FIG. 11*c*) as a guide, and the cutout 484 for the upper bearing bushing and the cutout 485 for the lower bearing bushing (see FIG. 9*e*) or the cutout 502 for the freewheel of the turntable 481 (see FIG. 9*e*) in side and top view as well as section E"/F (see FIG. 9*e*).

Figure 14A:
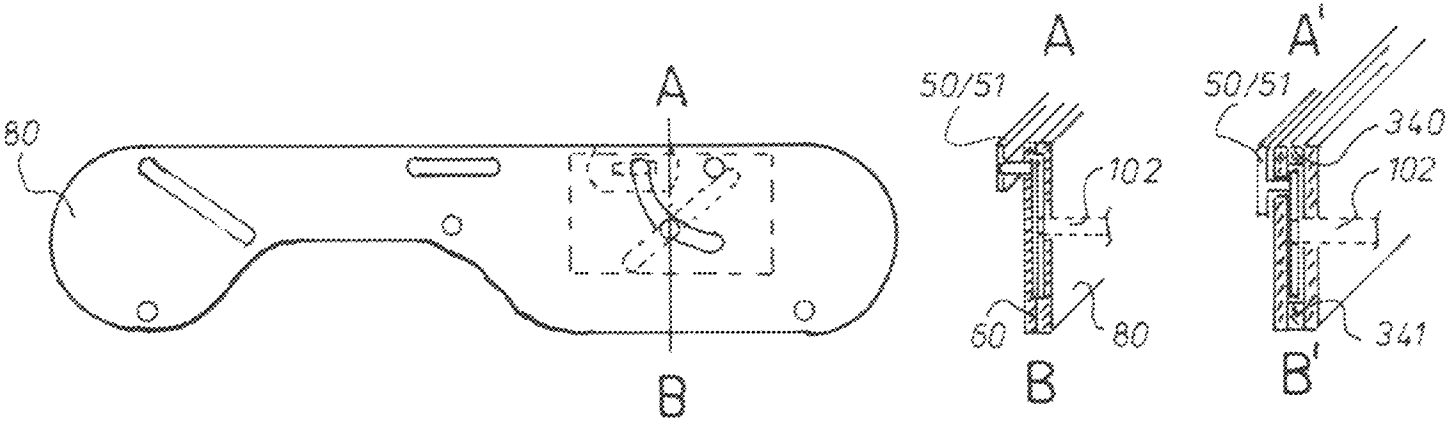
FIG. 14*a*-14*e* Detailed views of embodiments with regard to the actuation of the lock of the lying apparatus according to the disclosure.

FIG. 14*a* shows the inner side panel 80 with inserted slider 70 (see FIG. 5) and actuation knob 50/51 (see FIG. 9*a*) and the bearing block 102 (see FIG. 5). Section A/B shows the lateral operation by means of knob 50/51 (see FIG. 9*a*) with inner and outer side part 80 (see FIG. 5) and 60 (see FIG. 5), slider 70 (see FIG. 5) and bearing block 102 (see FIG. 5)). Section A'/B' shows a so-called sandwich design in which the cutout 61 (see FIG. 5) in the outer side panel 60 (see FIG. 5) and the cutout 81 (see FIG. 5) In the inner side panel 80 (see FIG. 5) are missing and are replaced by a sandwich insert. The guide strips 340 and 341 remain in the guide area of the slider. The sandwich design simplifies production, since the side panels no longer have milled recesses and can therefore be processed more quickly.

Figure 14B:
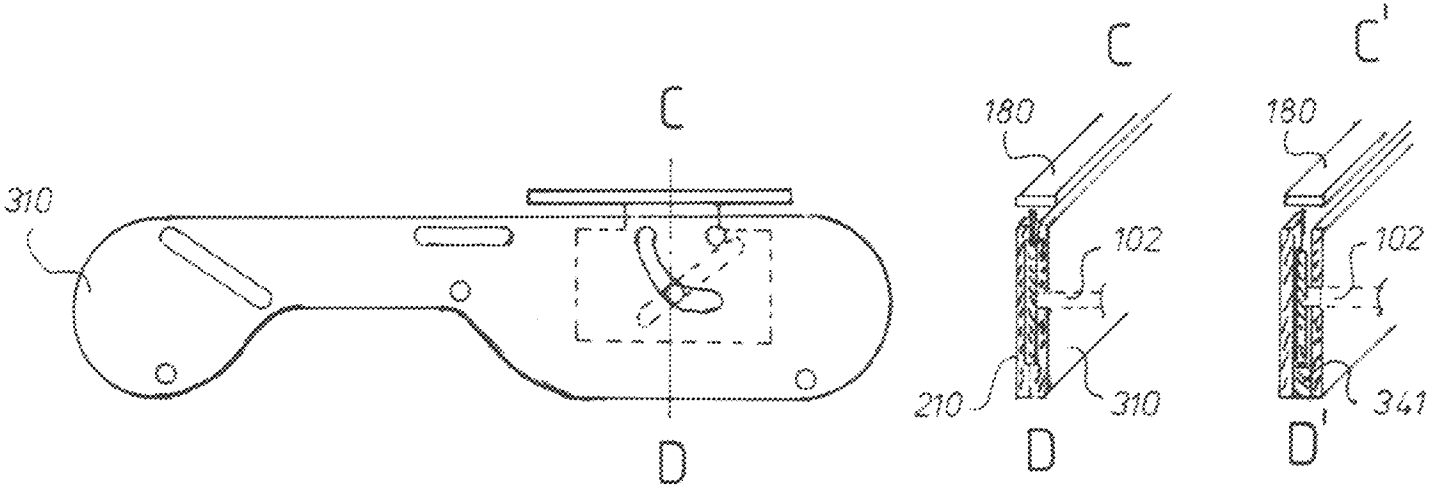

FIG. 14*b* shows the inner side panel 310 with inserted slider 260 (see FIG. 11*b*) and actuation by the armrest 180 (see FIG. 9*b*) and the bearing block 102 (see FIG. 5). Section C/D shows the operation by armrest 180 (see FIG. 9*b*) with inner and outer side panels 310 (see FIG. 13*b*) and 210 (see FIG. 10*b*), shutter 260 (see FIG. 11*b*) and bearing block 102 (see FIG. 5)). Section C/D shows a so-called sandwich design in which the cutout 211 (see FIG. 10*b*) in the outside side panel 210 (see FIG. 10*b*) and the cutout 311 (see FIG. 13*b*) in the inside side panel 310 (see FIG. 13*b*) are missing and are replaced by a sandwich insert. The guide rails 340 and 341 remain in the guide area of the slider, whereby only guide rail 341 is visible in the section. The sandwich construction simplifies production, since the side panels no longer have any cut-outs and can therefore be processed more quickly.

Figure 14C:
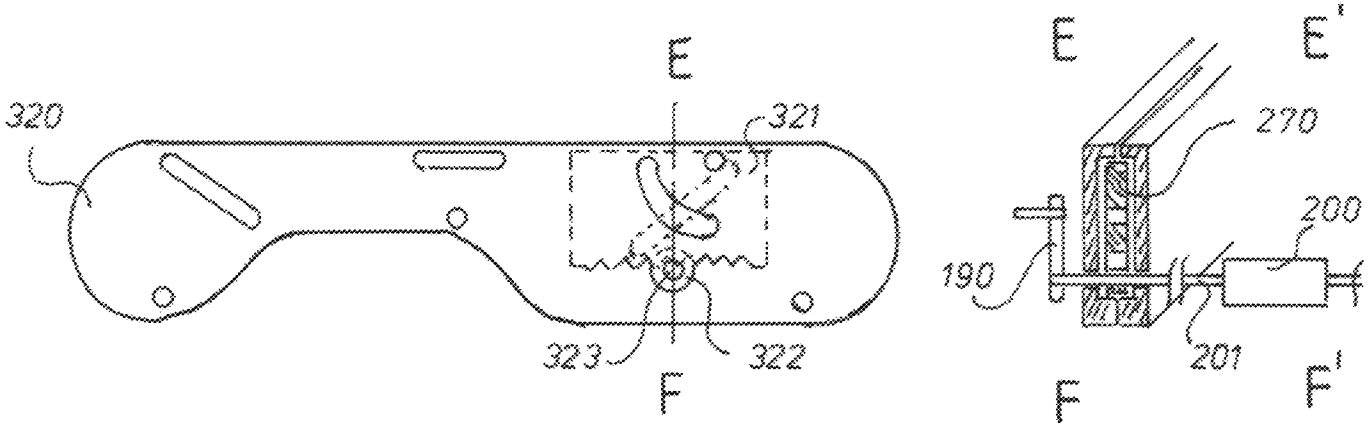

FIG. 14*c* shows the inner side panel 320 with inserted slider 270 (see FIG. 11*c*) and actuation by the armrest 180 (see FIG. 9*b*) and the bearing block 102 (see FIG. 5) as well as the milled recess 322 for the freewheel of the gearwheel 194 (see FIG. 9*c*) or the pinion 202 (see FIG. 9*d*) and the bearing hole 323 to accommodate the crankshaft 193 (see FIG. 9*c*) or motor shaft 201 (see FIG. 9*d*). Section E/F shows the slider 270 (see FIG. 11*c*) for actuation by the crank 190 (see FIG. 9*c*) and E'/F' by the motor 200 (see FIG. 9*d*). Of course, this variant can also be produced in the sandwich construction.

Figure 14D:
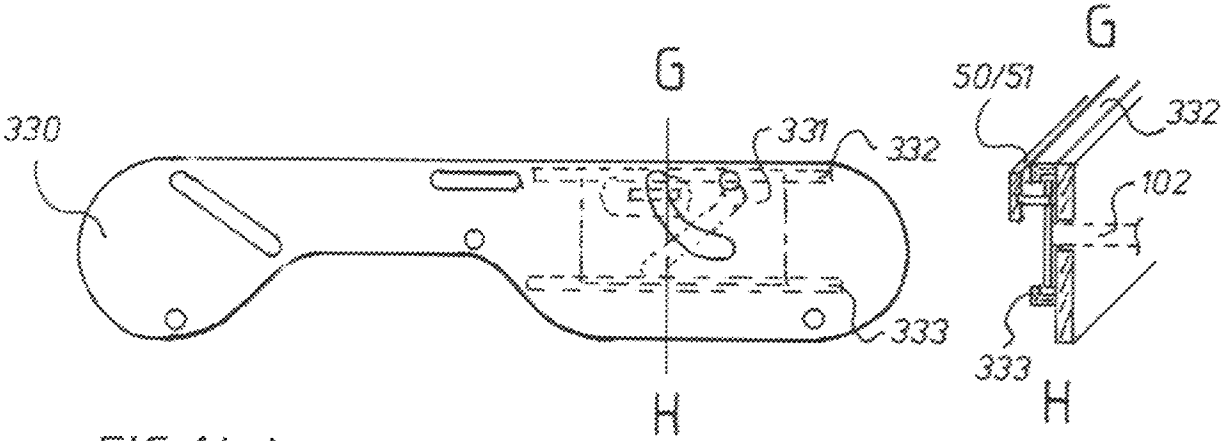

FIG. 14*d* shows the inner side panel 330 with inserted slider 70 (see FIG. 5) and actuation knob 50/51 (see FIG. 9*a*) and the bearing block 102 (see FIG. 5) as well as two externally mounted guide strips 332 and 333 for the slider 70

(see FIG. 5). Section G/H shows the lateral actuation by means of knob 50/51 (see FIG. 9*a*) with inner side part 330, shutter 70 (see FIG. 5), bearing block 102 (see FIG. 5) and the attached guide strips 332 and 333.

This variant is a correct material and time saving variant for production, since the slider is not enclosed as in the other variants, but lies freely and only an inner side part is installed.

Figure 14E:
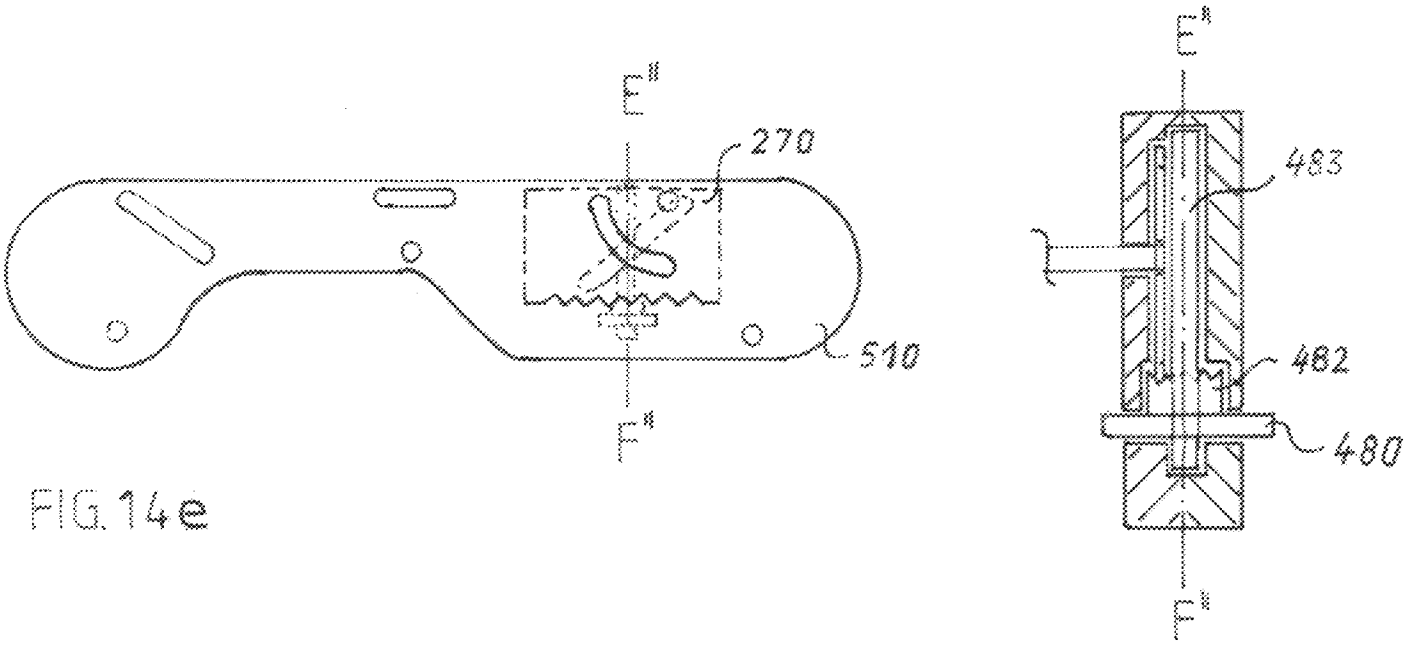

FIG. 14*e* shows the inner side panel 510 with inserted slider 270 (see FIG. 11*c*) and actuation by the handwheel 480 (see FIG. 9*e*) and the toothed wheel 482 (see FIG. 9*e*) as well as the cutout 502 for the freewheel of the turntable 481 (see FIG. 9). Section E"/F" shows the slider 270 (see FIG. 11*c*) for actuation by the handwheel 480 (see FIG. 9*e*). Of course, this variant can also be manufactured in the sandwich design.

Figure 15A:
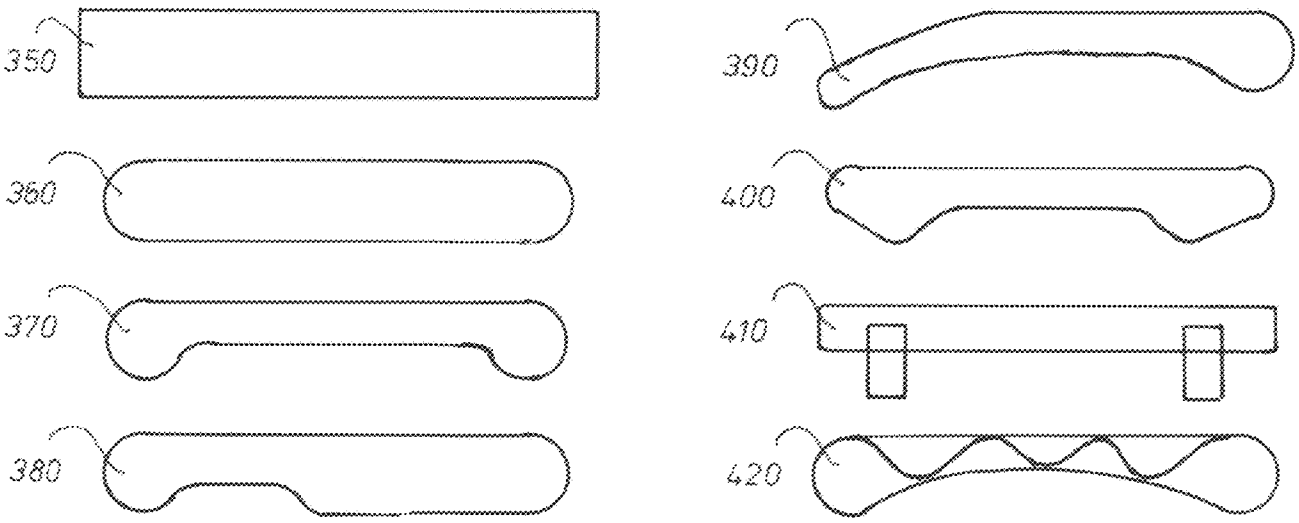
FIG. 15*a*-15*b* Detailed views of embodiments with regard to the side parts and their guides of the lying apparatus according to the disclosure.

FIG. 15*a* shows as an example the different versions in form and function as well as application, which may vary depending on the material used. Some frame shapes, lying surface designs and bearing designs are shown as examples. The simplest side panel/frame shape is the rectangle 350, the shape 380 rounded at both ends is just as easy to produce. With the Form 370 there are only two support points and the design with a self-locking mechanism using sliders becomes a challenge. Ideally, the 380 variant is used with a slide, as the slide is fully enclosed and not visible. Variant 390 only allows the use of a lowered foot section, but is probably the most aesthetic. Variant 400 again has only two support points and is particularly suitable for mounting wheels. Variant 410 again represents a cost-saving variant with separate supports mounted on the outside, in which, in combination with an external slider, probably the most cost-effective version can be realized. Variant 420 is probably best suited for a design in metal or plastic to guarantee the stability of the fragile design.

Figure 15B:
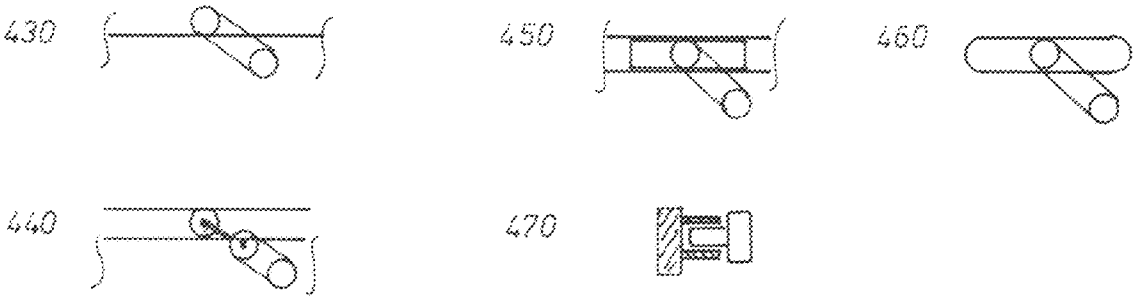

FIG. 15*b* shows schematically the different variations of the bearing design. Version 430 shows a roller support with a wooden roller. Version 440 shows a roller bearing which is an axle with a wheel/roller attached to it, which runs in a guide. The version 450 shows a slide bearing where a block is inserted in a guide rail. Version 460 shows the slide bearing used here (simply a wooden round bar that slides back and forth on the smoothed base. In order to avoid disturbing noises, it is recommended to oil, wax, soap or to use a metal (brass) or a plastic coating on the running surface. Version 470 shows a pivot bearing, which for stability reasons will probably only be used for a metal or plastic couch.

Figure 16A:
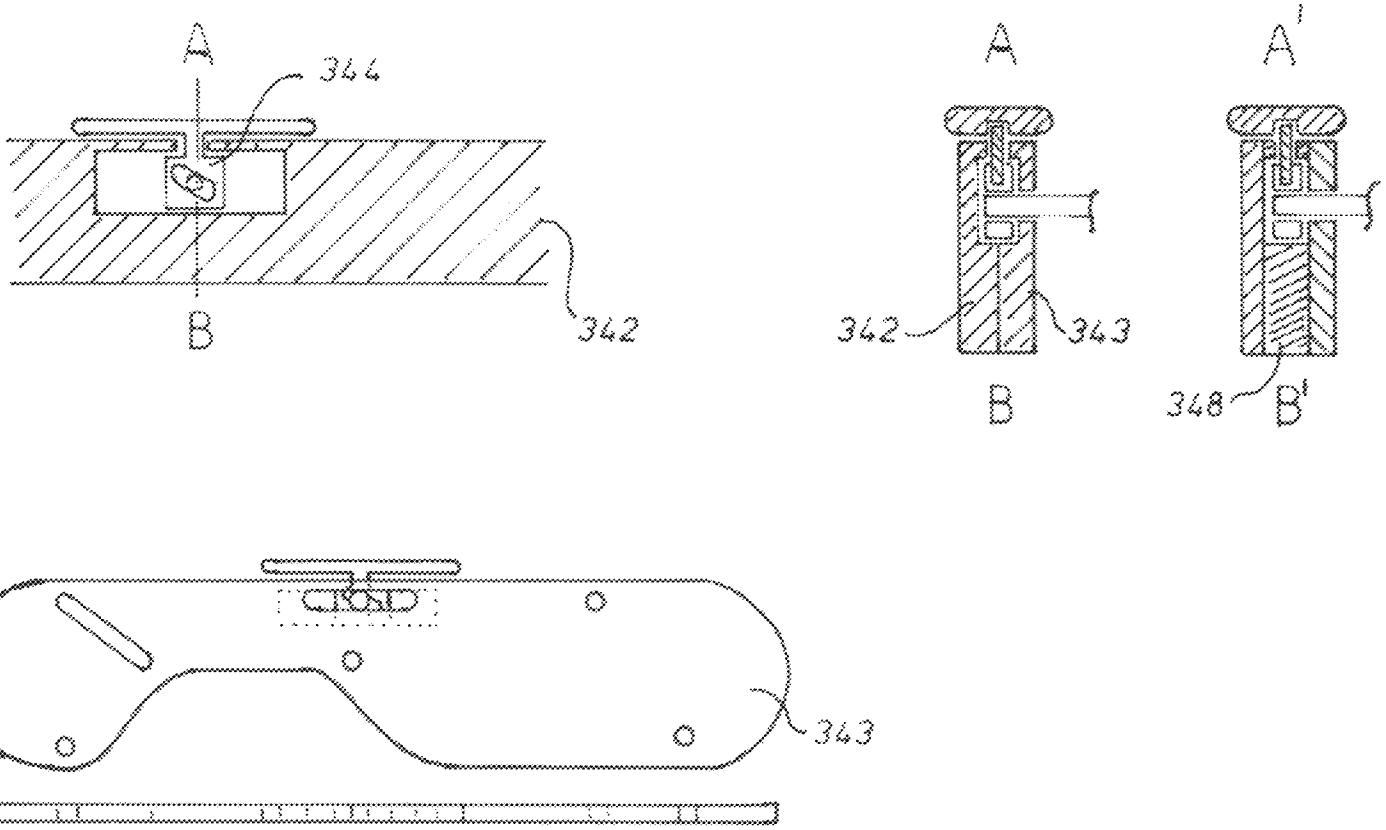
FIG. 16*a*-*d* schematic views of further embodiments regarding the locking of the lying device according to the disclosure.

FIG. 16*a* shows the outer side panel 342 with actuating armrest and inserted shortened slider 344, in order to be able to realize other slimmer forms of the couch like 390 (see FIG. 15*a*). Also shown is the inner side panel 343, where the circular cutout 82 (see FIG. 5) can be omitted. Section AB shows the milled version and section A'/B' shows the sandwich version with the intermediate layer 348.

Figure 16B:
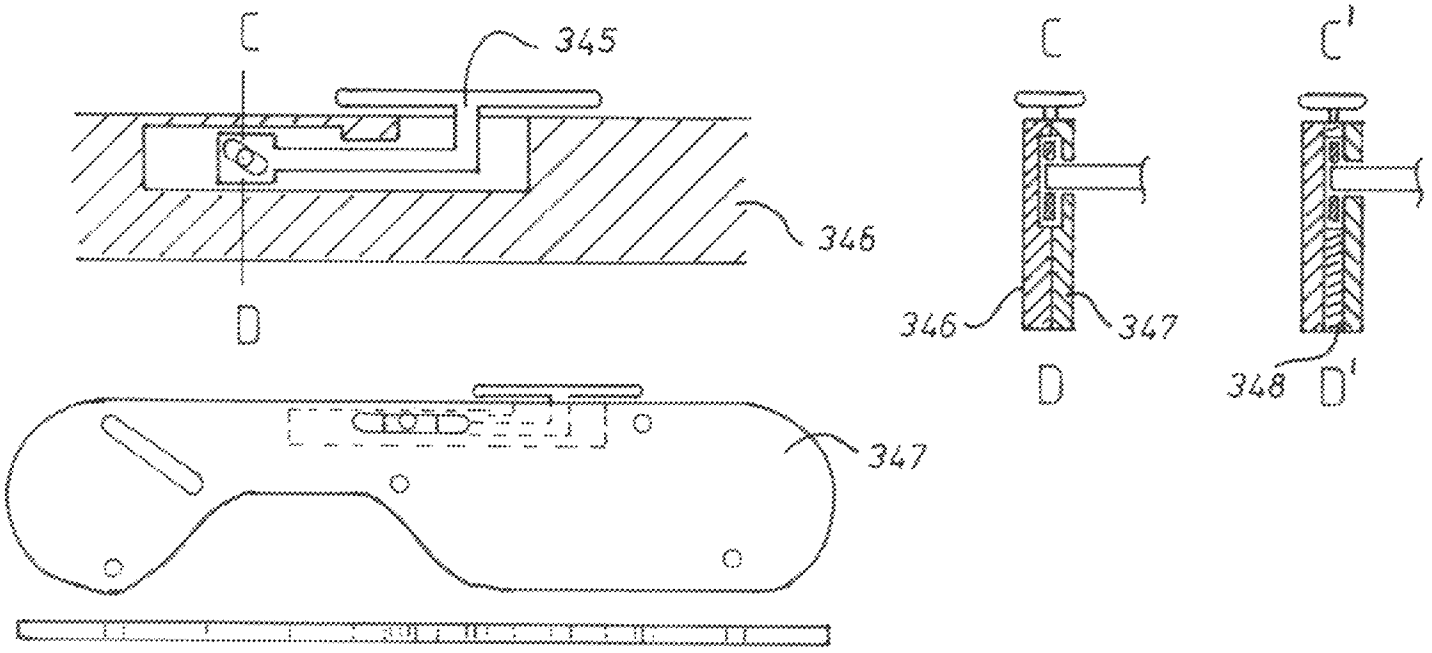
Figure 16C:
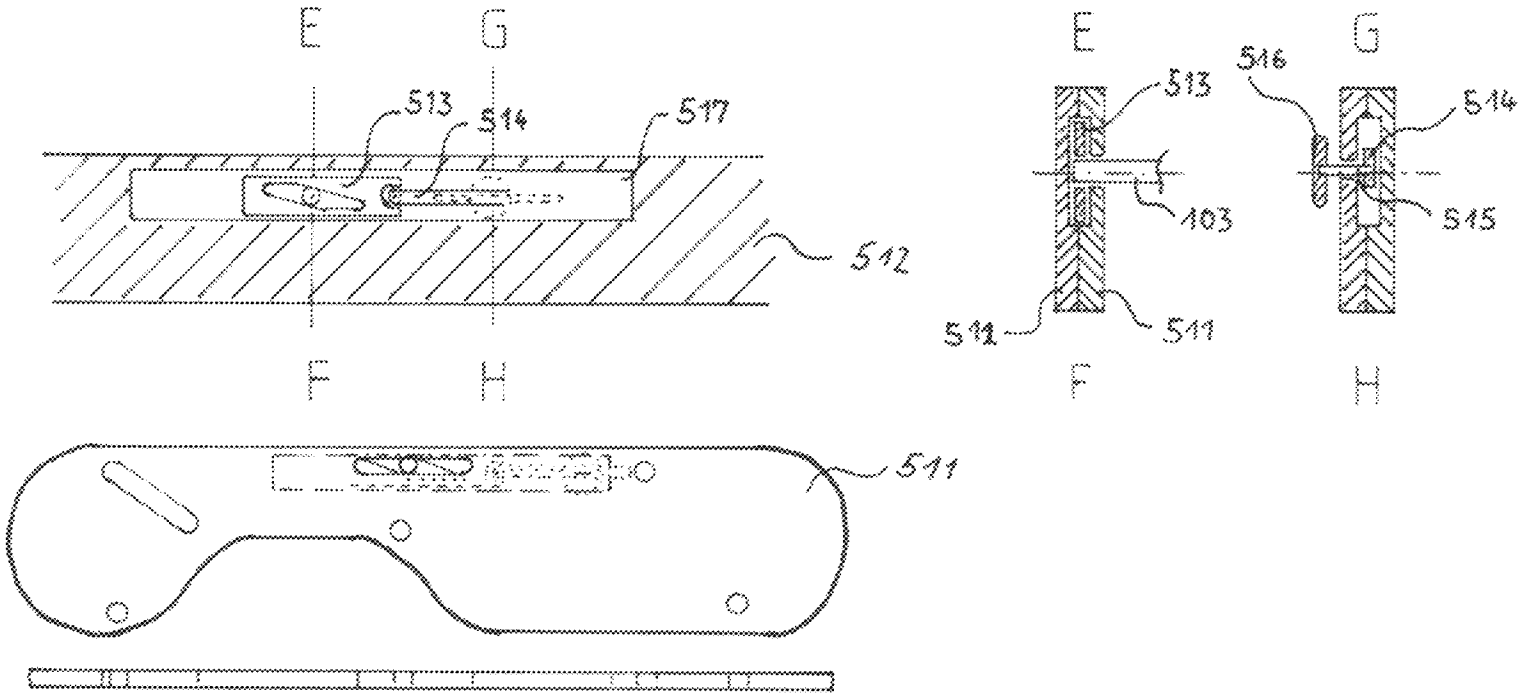
Figure 16D:
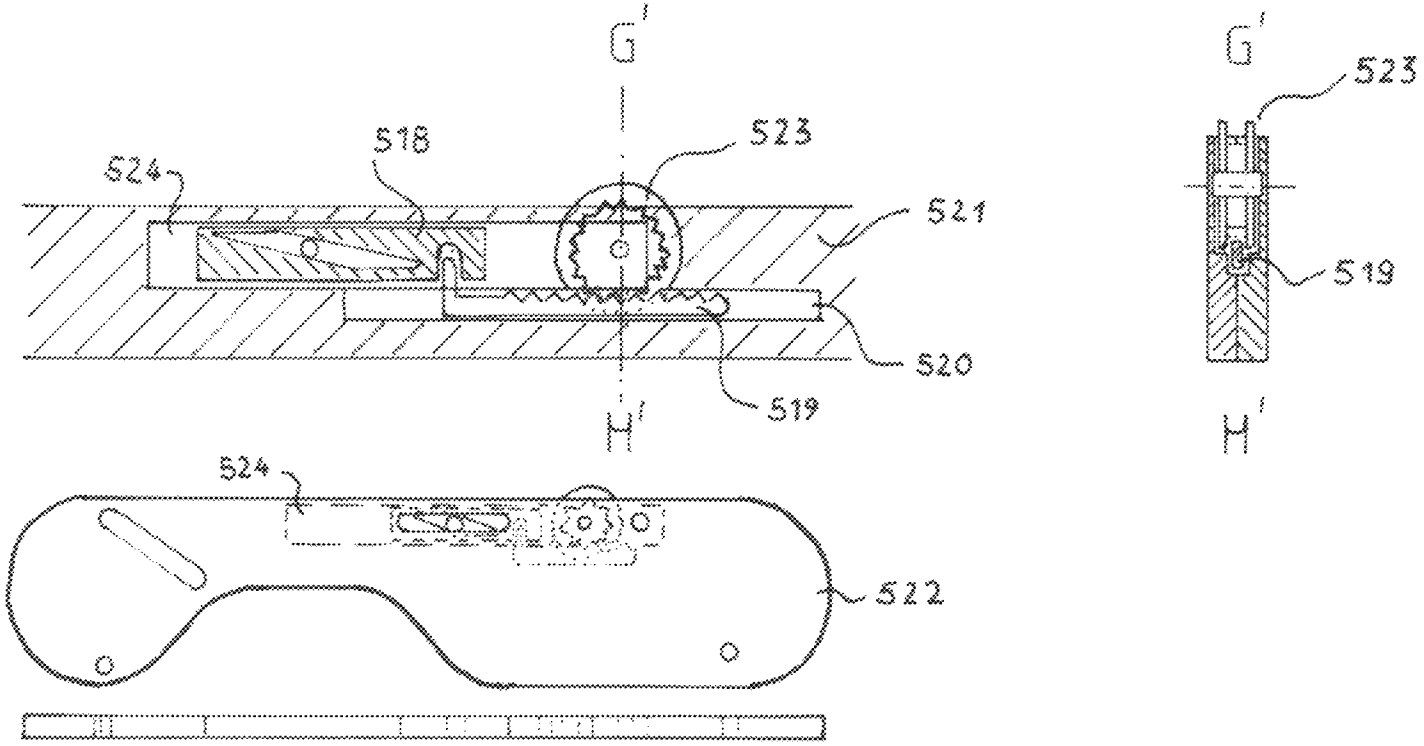

FIG. 16*b* shows the outer side panel 346 with long actuating armrest and inserted shortened slider 345. The inner side panel 347 is also shown where the circular cutout 82 (see FIG. 5) can also be omitted. Section C/D shows the milled version and section C'/D' shows the sandwich version with the intermediate layer 348.

FIG. 16*c* shows the inner side panel 511 with inserted slider 513, slider stick 514 and actuation by the round knob 516 using the connecting piece 515. Section E/F of FIG. 16*c* shows slider 513 and slider stick 103. Section G/H shows slider stick 514, connecting piece 515 for actuation by knob 516. Of course, this variant can also be produced in the sandwich design.

FIG. 16*d* shows the inner side panel 522 with inserted slider 518 and actuation by the toothed handwheel 523 using the sliding stick 519, the corresponding cutout 520 and the cutout 524 for the slider 518. Section G'/H' of FIG. 16*d* shows the sliding stick 519 and the toothed handwheel 523. Section G/H shows the sliding stick 514, the connecting piece 515 for actuation by the knob 516. Of course, this variant can also be produced in sandwich construction.

As can be seen from the above explanations, the present disclosure concerns the infinitely variable adjustment and self-locking of the ergonomic couch (kink points are located on the one hand in the hip area and on the other hand in the knee area and not, as with other couches, in the back area and without knee bend) which block each other due to the intersecting directions of movement of the sliding stick 70 (see FIG. 5) (horizontal) and the bearing stick 102 (see FIG. 5) (circle—or vertical, movable connection between backrest and seat). This functionality requires the required inclined oblong hole 72 (see FIG. 5) in the slider 70 (see FIG. 5) to accommodate the bearing block 102 (see FIG. 5) and the—circular arc cutout 82 (see FIG. 5) for the free run of the bearing block 102 (see FIG. 5) in the inner side panel 80 (see FIG. 5). Likewise, the two cutouts 61 (see FIG. 5) and 81 (see FIG. 5) on the inside of the side panels 60 (see FIG. 5) and 80 (see FIG. 5) are relevant as guides for the slider 70 (see FIG. 5). There are three variants for the operation of the shutter 70 (see FIG. 5). On the one hand by means of the knob (consisting of two parts 50 and 51) which is attached to the side and can move freely in the oblong hole 62 (see FIG. 5) of the side part 60 (see FIG. 5) with the connector 51 (see FIG. 5) and on the other hand by means of the slot 72 (see FIG. 5) which is firmly connected to the slider 70 (see FIG. 5). On the other hand, it is possible to actuate the shutter 260 (see FIG. 11*b*) vertically via the connecting bar 262 (see FIG. 11*b*) by means of an armrest 180 (see FIG. 9*b*). The shutter 70/260 can only be actuated when the bearing block 102 (see FIG. 5) is relieved by shifting the center of gravity of the body (by tensing or relaxing the abdominal muscles of the user). Or by a pinion 194 (see FIG. 9*c*) driven by a motor or manually by means of a crank 190 (see FIG. 9*c*) which is equipped with the slider 270 (see FIG. 11*c*) with a toothing 272 (see FIG. 11*c*) at its lower end. This functionality can also be achieved by a pure push/pull movement of the bearing block 103 onto the slider 344 or, as shown in FIGS. 16*c* and 16*d*, onto slider 513 or slider 518. This applies to symmetrical self-locking. In the case of asymmetrical self-locking, the movement is only blocked when leaning back and not when straightening up.

In addition to the correct kink in the hip area, the footrest is also lowered in the sitting position and a further kink is created in the user's knee area. This prevents tension and strain on the knee joint. This is achieved by means of the inclined guide long holes 84 (see FIG. 5) in the inner side panels 80 (see FIG. 5) and the connection of the backrest 23 (see FIG. 2) with the seat surface 24 (see FIG. 2) and the footrest 25 (see FIG. 2) by means of the bearing blocks 102, 103 and 104 (see FIG. 5), which on the one hand connect these lying surfaces with each other and at the same time serve as supports in the respective guide long holes 83 (see FIG. 5). The pivot point is the bearing block 101 which is firmly glued in the back section and can rotate in the bearing hole 88 (see FIG. 5) in the inner side panel 80 (see FIG. 5).

Furthermore, experience has shown that the bath towel can slip off the backrest when sitting down and has to be put back into position. Due to the design of the uppermost rung as loose round bar 100 (see FIG. 5) of the lying device according to the disclosure, which can be moved freely in the holes 97/137 (see FIG. 5) of the two side parts 90/130 (see FIG. 5), the bath towel can be simply folded over with or without removing (threading the bath towel) the round bar 100 (see FIG. 5) and it will not slip down when the couch is raised into the sitting position.

The lounger according to the disclosure can be made of various materials such as metal, wood, plastic, ceramics, hard paper, cardboard and rattan as well as different shapes, colors and designs. Depending on the material and design, the invention-compliant lounger can be used indoors or outdoors, as it works without electricity.

The side parts or frames of the couch according to the disclosure can be designed differently depending on the material and thus also have an effect on the storage areas (see FIG. 15*b*) or the type of slider used (for variants, see FIG. 15*a*. FIGS. 16*c* and 16*d*) and on the static elements (in wooden design round rods 110, 111, 112 or boards), which form an imaginary triangle with the inner side parts 80 (see FIG. 8).

As shown in FIG. 8, the couches can be designed with or without rollers and different solutions are shown (without rollers 170, inside lying 171, inside lying half sunken 172, outside lying half sunken 173, inside lying 174 and outside lying 175).

The design of the bearings depends on the material and can be made in wood as simple support or with metal inlay e.g., brass, self-lubricating), roller bearing, plain bearing or journal bearing. This also applies to the position or alignment of these bearings (see FIG. 15*b*).

The lying surfaces (see FIG. 2) also shown in rung design, can, depending on the material used, consist of simple boards, rungs, tubes, rods, a covering (including plastic, textiles, leather, wire, paper-wrapped wire, ropes or cords) or a grid, a perforated plate or plates which may also be provided with recesses.

In general, there are two variants of self-locking in the wooden version.

On the one hand, the housed version with lateral knob (see FIG. 5, parts 50 and 51), with armrest 180 (see FIG. 9*b*), with crank 190 (see FIG. 9*c*) or with motor 200 (see FIG. 9*d*)—which is again divided into two groups. A milled guide in the side part and the sandwich construction. On the other hand, the non-housed version with open guide of the slider 70 (see FIG. 14*d*) and the guide rails 332 and 333 (see FIG. 14*d*).

In addition, depending on the material used, different versions of the frame construction are also possible. Once made of boards as shown above, or simple frames made of solid metal, tubes (round, oval, square, rectangular, etc.) or plates, folding material and slats are possible.

The present couch made of wood is designed in such a way that all connections are only galvanized, drillings which are permanently fixed with wood glue. This is on the one hand very ecological and on the other hand very advantageous for the manufacturing process. However, the connections can also be made with screws, in order to realize simpler constructions without galvanization. In any case, screwed or welded connections are used for metal couches.

To Increase comfort, a support is placed on the lying surface, which is either a standard foam mat covered with fabric or leather, or a support made of woven sheep's wool, which can be easily attached with a Velcro fastener. Of course, it is also possible to use a normal bath towel. Likewise, roll pads in the neck, back or knee area can also be used.

Thus, the present disclosure relates to a reclining device for variable adjustment of the position between an essentially horizontal position and an ergonomic sitting position, which has at least one right and one left side part, each of which consists at least of an outer side part 60 and an inner side part 80, a backrest element 90 and a seat element 91, which are rotatably connected to each other via a first bearing block 102, and foot element 92, which is rotatably connected to the seat element 91 via a second bearing block 103, wherein the foot element 92 is supported between the right and left side parts via a third bearing block 104, and wherein the first, second and third bearing blocks 102, 103, 104 are each mounted in a corresponding guide in the right and left side part so as to be translatably movable in such a way that the backrest element 90, the seat surface element 91 and the footrest element 92 are variably adjustable between a substantially horizontal position and an ergonomic sitting position, and wherein the first bearing block 102 is locked by self-locking via a locking slide 70 in a locking cutout 61 in at least one outer side part 60, and wherein the self-locking can be lifted by the user via a hand knob. This functionality can also be achieved by a pure push/pull movement of the bearing block 103 onto slide 344, or as shown in FIGS. 16*c* and 16*d* onto slide 513 or slide 518. This apples to symmetrical self-locking. In the case of asymmetrical self-locking, the movement is only blocked when leaning back and not when straightening up. Self-locking is also functional if the principle is reversed 180 and the roles (active and passive) of the components are swapped.

There is generally the possibility of symmetrical self-locking with blocking in both directions of movement (with parallel flanks of the slanting slot 71, 261, 271, 281, 291, 301 in the slide 70, 260, 262, 270, 280, 290, 300, 321, 331, 344, 513, 518) or asymmetrical self-locking with blocking in only one direction of movement with the preferred blocking/sliding direction, which is characterized by different angles of the slot 71, 261, 271, 281, 291, 301 in the slide 70, 260, 262, 270, 280, 290, 300, 321, 331, 344, 513, 518 for push/pull direction. This means that the two flanks of the slot are not parallel, but have different slopes. In blocker direction (leaning against the backrest), a flat angle is used to set the friction at maximum or as required for the specific application. In the opposite sliding direction (straightening up from the sitting position) a steep angle is used to set the friction to a minimum or as required for each application. This results in an asymmetrical motion sequence which allows full braking in one direction (self-locking) and maximum sliding in the opposite direction (very little or no self-locking).

The invention claimed is:

1. A lying device for variable adjustment between a substantially horizontal position and an ergonomic sitting position comprising:

a right side part and a left side part, each of which comprises at least an outer side part and an inner side part;

a backrest element and a seat element, which are rotatably connected to each other via a first bearing block; and a foot element rotatably connected to the seat element via a second bearing block, the foot element being supported between the right and left side parts via a third bearing block;

wherein the first, second and third bearing blocks are each mounted in a corresponding guide in the right and left side parts so as to be translatably movable in such a way that the backrest element, the seat element and the foot element are variably adjustable between a substantially horizontal position and an ergonomic sitting position, and wherein the first bearing block is lockable by self-locking via a movable locking slide in a locking recess in at least one outer side part, and wherein the self-locking can be cancelled by the user via at least one hand knob.

2. The device according to claim 1, wherein the first bearing block extends through an arcuate recess of the inner side part and is configured to be guided and displaced in an elongated hole of the locking slide for variable adjustment of position between a substantially horizontal position and an ergonomic seated position when the self-locking is released by means of the at least one hand knob.

3. The device according to claim 1, wherein the locking slide is configured to be guided in a guide of the inner side part.

4. The device according to claim 1, wherein the locking slide is displaceable by actuation of the at least one hand knob in the locking recess, with the self-locking effect being cancelled, the self-locking effect being produced by wedging the locking slide in the locking recess when the actuation of the at least one hand knob by the user is cancelled.

5. The device according to claim 1, wherein the backrest element is supported between the right and left side parts so as to be rotatable about a rotation axis, the rotation axis and the first bearing block being configured to determine position of the backrest element.

6. The device according to claim 1, further comprising a first bar, a second bar and a third bar provided between the right and left side parts for stabilization, which form a triangle with each other, wherein the first and third bars form a base of the triangle and each of the first and third bars is configured to accommodate a wheel for rolling movement.

7. The device according to claim 1, wherein at least the right and the left side parts as well as the backrest element, the seat element and the foot element are made of wood.

8. The device according to claim 1, wherein at least the right and the left side parts as well as the backrest element, the seat element and the foot element are made of plastic.

9. The device according to claim 1, wherein at least the right and the left side parts as well as the backrest element, the seat element and the foot element are constructed of metal.

* * * * *